US007926810B2

(12) United States Patent
Fisher et al.

(10) Patent No.: US 7,926,810 B2
(45) Date of Patent: Apr. 19, 2011

(54) ROULETTE APPARATUS WITH BALL-DELIVERY SYSTEM, AND METHOD

(75) Inventors: Donald Fisher, Cary, IL (US); Melissa S. Langtim, Elgin, IL (US); Douglas Krich, Cary, IL (US); Darlene Marie Garmann, Watford City, ND (US); Stephen Foote, Yaroomba (AU)

(73) Assignee: Cantor G & W (Nevada), New York, NY (US)

( * ) Notice: Subject to any disclaimer, the term of this patent is extended or adjusted under 35 U.S.C. 154(b) by 660 days.

(21) Appl. No.: 11/711,546

(22) Filed: Feb. 27, 2007

(65) Prior Publication Data

US 2008/0132315 A1 Jun. 5, 2008

Related U.S. Application Data

(63) Continuation-in-part of application No. 11/634,780, filed on Dec. 5, 2006, now abandoned.

(51) Int. Cl.
*A63F 5/00* (2006.01)

(52) U.S. Cl. ..... 273/274; 273/142 E; 273/142 R; 463/17

(58) Field of Classification Search ..... 273/274, 273/142 E, 142 F, 142 G, 142 R; 463/17
See application file for complete search history.

(56) References Cited

U.S. PATENT DOCUMENTS

| | | | | |
|---|---|---|---|---|
| 958,722 | A | 5/1910 | Chalmers | |
| 1,520,697 | A | 12/1924 | Carlson | |
| 1,676,410 | A | 7/1928 | Paul | |
| 1,709,401 | A | 4/1929 | Hermann | |
| 2,087,555 | A | 7/1937 | Simpson | |
| 2,210,201 | A | 8/1940 | Draper et al. | |
| D159,405 | S | 7/1950 | Bossart | |
| 2,721,082 | A | 10/1955 | Hunold | |
| 3,090,623 | A * | 5/1963 | Dugan | 273/142 R |
| 3,583,701 | A * | 6/1971 | Glass et al. | 273/445 |
| 3,853,324 | A | 12/1974 | Reiner et al. | |
| 3,989,252 | A * | 11/1976 | Mattson | 273/120 R |
| 4,095,794 | A * | 6/1978 | Garto et al. | 273/351 |

(Continued)

FOREIGN PATENT DOCUMENTS

CH 620782 12/1980

(Continued)

OTHER PUBLICATIONS

US PTO Office Action for U.S. Appl. No. 11/732,995; Oct. 2, 2009; 15 pages.

(Continued)

*Primary Examiner* — Benjamin H Layno
(74) *Attorney, Agent, or Firm* — Oleg A. Mestechkin

(57) ABSTRACT

A roulette apparatus enables and enhances roulette gaming. The roulette apparatus comprises a roulette wheel assembly, a ball-delivery tower, ball-conducting conduit, and disguised wheel monitoring equipment. The ball-delivery tower comprises a tower support portion and a tower arm. The tower arm may enclose and partially disguise the wheel-monitoring equipment. The tower support portion provides a certain vertical dimension for maximizing roulette ball potential energy. The ball-conducting conduit extends intermediate a ball inlet and a ball outlet. The ball outlet is positioned for outletting the roulette ball upon an upper wheel surface of the roulette wheel assembly. The tower and the ball-conducting conduit convert roulette ball potential energy to roulette ball kinetic energy and further function to effect a self-launching roulette ball for enhancing the roulette gaming experience.

27 Claims, 14 Drawing Sheets

U.S. PATENT DOCUMENTS

| | | | | |
|---|---|---|---|---|
| 4,149,728 | A | 4/1979 | Thompson | |
| 4,222,561 | A | 9/1980 | Whitten | |
| 4,357,015 | A * | 11/1982 | Santora et al. | 463/22 |
| 4,778,186 | A | 10/1988 | Dudley | |
| 4,941,665 | A | 7/1990 | Klamer | |
| 5,102,135 | A | 4/1992 | Addiecht | |
| 5,259,616 | A | 11/1993 | Bergmann | |
| 5,755,440 | A | 5/1998 | Sher | |
| 5,934,999 | A | 8/1999 | Valdez | |
| 6,164,647 | A | 12/2000 | Chee | |
| 6,227,542 | B1 | 5/2001 | Cosmi | |
| 6,406,022 | B1 | 6/2002 | Nadibaidze | |
| 6,663,106 | B1 | 12/2003 | Cosmi | |
| 6,869,359 | B1 | 3/2005 | Mathews | |
| 6,921,072 | B2 | 7/2005 | Hughes-Watts | |
| 2005/0167912 | A1 | 8/2005 | Sokolov | |
| 2005/0261048 | A1 | 11/2005 | Evans | |
| 2005/0285336 | A1 | 12/2005 | Ilievski | |
| 2007/0246883 | A1 * | 10/2007 | Cudlipp | 273/144 R |

FOREIGN PATENT DOCUMENTS

| | | |
|---|---|---|
| GB | 1113668 | 5/1968 |
| GB | 2304295 | 3/1997 |
| WO | WO 95/05877 | 3/1995 |

OTHER PUBLICATIONS

US PTO U.S. Appl. No. 11/732,995 filed Apr. 5, 2007; 79 pages.

US PTO U.S. Appl. No. 11/711,374 filed Feb. 27, 2007; 63 pages.

US PTO U.S. Appl. No. 11/634,780 filed Dec. 5, 2006; 54 pages.

US PTO U.S. Appl. No. 12/746,408 filed Jun. 4, 2010; 39 pages.

US PTO Office Action for U.S. Appl. No. 11/732,995; Jul. 9, 2010; 11 pages.

International Search Report for PCT/AU2007/001880 dated Mar. 7, 2008; 5 pages.

* cited by examiner

ROULETTE APPARATUS WITH BALL-DELIVERY SYSTEM, AND METHOD

PRIOR HISTORY

This application is a continuation-in-part patent application claiming the benefit of U.S. patent application Ser. No. 11/634,780 filed in the United States Patent and Trademark Office on Dec. 5, 2006 now abandoned, and any legal equivalent thereto.

BACKGROUND OF THE INVENTION

1. Field of the Invention

The present invention relates generally to games of chance, and more particularly to novel variations on the roulette wheel and wagers placed thereon. The present invention comprises a roulette wheel assembly comprising a roulette ball accelerator with ball launcher. The apparatus may be used to accelerate and deliver multiple roulette balls to a roulette wheel for enhancing the roulette gaming experience.

2. Description of the Prior Art

Gaming is ancient. Over time, core gaming themes and gaming rules have developed, which continue to enjoy wide popularity. In order to infuse some element of novelty into ancient games, gaming enthusiasts continually strive to enhance the gaming experience through inventive approaches to play. Roulette, for example, has been credited to many ancient sources, including Chinese origins and Roman origins. A more popularly held belief is that Blaise Pascal, the French mathematician (1623-1662) and physicist helped develop the essential Roulette device(s), due, in part, to his fascination with perpetual motion machines.

Whatever its origin, roulette has evolved into a casino and gambling game in which a croupier turns a round roulette wheel having 37 or 38 separately numbered pockets in which a roulette ball must land. Conventional roulette wheels comprise pockets or wheel sectors numbered non-sequentially from 1 to 36 alternating between red and black backdrops. Most modern Roulette wheels further comprise at least one green pocket numbered "0". Further, in the United States (as opposed to Europe), most roulette wheels comprise a second green pocket marked "00" ostensibly for increasing the house advantage in the United States as compared to house advantage in European play.

In United States-based play, if a player bets on a single number and wins, the payout is 35:1. Of course, any number of other betting options has become available to the gamer, which options offering lower payoffs, including bets on multiple numbers in various combinations or ranges, on all odd or all even numbers, or by color. Over time, variants on the basic Roulette theme have evolved including electronic betting through computer stations, fully electronic ball spin/wheel simulations, stand alone games on a slot machine or through Internet gaming, multiple balls, and characters other than numerals, such as zodiac symbols and the like.

To be sure, the state of the art relating to roulette gaming devices and the like is well developed, and a search into the state of the art reveals that a number of inventive Roulette-based gaming devices are known in the prior art. Some of the more pertinent prior art relating to Roulette type gaming devices of which the present inventors are aware, is briefly described and set forth below.

U.S. Pat. No. 3,853,324 ('324 patent), which issued to Reiner et al., discloses a Combined Game of Chance and Skill. The '324 patent teaches a combined game of chance and skill which is a modified form of the popular game known as bingo. The game includes a circular playing field, a longitudinal alley extending therefrom and a ball-propelling mechanism mounted at one end of the alley for propelling small and large indicating balls along the alley and onto the playing field. The playing field includes an outer member and an inner disc which are rotatably driven in opposite directions. The outer member is provided with a plurality of indicia-carrying partitions which are spaced to trap the large indicating ball which is propelled onto the playing field but are spaced to allow the small indicating ball to pass through the partitions and onto the inner disc. The inner disc is provided with a plurality of indicia-carrying, ball-receiving pockets adapted to receive the small indicating ball which passes through the partitions.

U.S. Pat. No. 4,222,561 ('561 patent), which issued to Whitten, discloses a Game Device. The '561 patent teaches a roulette type device whereby a predetermined set of word category cards are selected randomly one at a time together with spinning a roulette wheel to select the first letter designation for a word response by the players which satisfies both the category and first letter so selected. It will be seen from an inspection of the '561 patent that the roulette type wheel comprises a series of letters of the Roman alphabet thereon. The Whitten wheel includes a total of thirty-six lettered positions thereon, with certain of the letters being duplicitous. Whitten utilizes the device to enable random selection of a letter by his wheel to designate the first letter of an object from a group of related objects, e.g., kinds of fruit, etc. The subject user or gamer must come up with an object having a name that begins with the letter selected on the Whitten roulette wheel in order to win that particular play or turn.

U.S. Pat. No. 4,887,819 ('819 patent), which issued to Walker, discloses a Casino Board Game. The '819 patent teaches a relatively complex game, incorporating use of a roulette wheel and combines aspects of several different traditional or conventional gambling games. In this regard, the player uses either a card game similar to blackjack or a slot machine to determine the number of spaces to be moved along a segmented path, the particular game being selected by the instructions contained in the segment on which the player landed on the prior move. Each segment also contains further instructions, some of those instructions designating a further gambling apparatus and giving odds. These further apparatuses are a roulette game or a dice game, and the player landing on that segment may gamble at these games at the designated odds. Other players can join in the gambling when the roulette game and the dice game are played. The objective of the game is for a player to avoid penalties designated on the game board, acquire a majority of the playing chips until either all of the other players become "busted" or the casino bank becomes "busted". Notably, no alphabetic layout for the roulette wheel is disclosed.

U.S. Pat. No. 5,259,616 ('616 patent), which issued to Bergmann, discloses a Roulette-Type Coin-Operated Gaming Machine. The '616 patent teaches a process for operating a slot machine that works as a roulette wheel. According to the process, the gambler determines the amount of the stake by introducing coins then by pressing selection keys. A microprocessor determines the result of the game by means of random algorithm. When the chosen number is hit, the microprocessor instructs the coin distributing unit to eject the main prize. When a chosen number is hit, the microprocessor drives another processor with a random generator. The random generator determines, depending on a written algorithm, a gain multiplier which is multiplied by the amount of the stake on the number that was hit. The payment unit is then instructed to distribute an amount in coins which corresponds to the product of the stake on the number that was hit and the gain multiplier.

U.S. Pat. No. 5,553,853 ('853 patent), which issued to Sackitey, discloses a Game Apparatus and Method of Play for Teaching DNA Related Technologies. The '853 patent teaches a game including a selector for selecting a nucleotide from a group of nucleotides normally associated with DNA. By randomly selecting nucleotides and recording the selected nucleotides, each player creates a unique DNA sequence. The DNA sequence is used in one of a variety of game motifs to determine the winner of the game. It will be seen from an inspection of the '853 patent that a roulette-type wheel having a series of seventy-one lettered positions thereon enables play. Certain alphabetic characters are repeated, with several (Roman) alphabetic characters being omitted from the wheel.

U.S. Pat. No. 5,755,440 ('440 patent), which issued to Sher, discloses an Enhanced Roulette-Style Game. The '440 patent teaches a new Roulette apparatus comprising multiple balls and separate tracks for launching each of the balls. In a preferred embodiment there are two balls and two tracks, and a special apparatus for launching the balls. In one embodiment the launching apparatus is air powered, and in another the apparatus is mechanical with the balls accelerated by contact with a spinning wheel. In either case the launching apparatus may be hand-held or mounted to a frame and positioned to propel the balls into the tracks. In another aspect of the invention the wheel of the Roulette apparatus is provided as a dynamic display, which may be of several different types, such as LCD and dynamic holographic displays, and electronic player stations are provided wherein players may customize and place bets. In many embodiments the games are enhanced by audio effects including such sounds as balls being launched, balls rolling in Roulette apparatus, thunder strikes, and music. U.S. Pat. No. 6,164,647 ('647 patent), which issued to Chee, discloses a Casino Wheel Game System. The '647 patent teaches a roulette assembly comprising a lower wheel divided into a plurality of sections each representative of at least one of a unique number and a unique color. Also included is an upper wheel rotatably mounted on the lower wheel and divided into a plurality of sections each representative of at least one of a unique number and a unique color. Upon the upper wheel and the lower wheel being spun, the upper wheel slows to engage with the lower wheel and a unique number and color combination is indicated. It will be seen from an inspection of the '647 patent that a mechanically complex roulette wheel is disclosed. Upper and lower wheels may be randomly joined to select a specific color and number outcome on the lower wheel. Notably, no alphabetic designations on the wheel are disclosed.

U.S. Pat. Nos. 6,227,542 ('542 patent) and 6,663,106 ('106 patent), both of which issued to Cosmi, disclose certain Roulette of Improved Type and New Gambling Game Providing for the Use of Said Improved Roulette. The '542 and '106 patents teach roulette of a new type including two bowls coaxial to each other and rotating around the same axis and two small balls, each ball rolling around one of the bowls, where on each bowl are engraved data which refer to an independent event. On a first embodiment, the two independent events are: the signs of the zodiac, the numbers from 0 to 31, where the signs of the zodiac are preferably engraved on the external, ring-shaped bowl, while the numbers from 0 to 31 are preferably engraved on the internal bowl. On a second embodiment, the events engraved on the two bowls are related to one or more of the calendars used in Asiatic countries (China, Korea, Japan and so on). Furthermore, a new gambling game providing for the use of said improved roulette is described.

U.S. Pat. No. 6,406,022 ('022 patent), which issued to Nadibaidze, discloses a Method of Playing a Roulette-Type Mass Amusement Game Having a Betting Field with Zodiac Signs. The '022 patent teaches a method of mass amusement using a stake field simulating a roulette-type betting field with various-color stake squares with various-color information marks from 1 to 36 formed thereupon and the twelve Zodiac signs in the stake squares with digital information marks 1, 2, 3, 5, 7, 11, 13, 17, 19, 23, 29, and 31. Also formed is a flat image of a stationary roulette wheel having 36 main sectors and one or two additional sectors, with each main sector to contain, first, the images of digits from 1 to 36 with the images of the twelve Zodiac signs in the places of location of the prime numbers 1, 2, 3, 5, 7, 11, 13, 17, 19, 23, 29, and 31, and, secondly, two images of the hexagonal die with information marks being various number of spots: from one to six. Then, the players place their bets on the stake squares of the stake field, the procedure to be followed by choosing two pairs of random gambling indices by means of double simultaneous casting of two hexagonal dice.

United States Patent Application Publication No. 2005/0285336, which was authored by Ilievski, discloses an alphabetic roulette game comprising a roulette wheel having twenty-five positions thereon, comprising the twenty-six letters of the Roman alphabet and a double letter position. A wagering surface or table provides for the placement of wagers upon the chance of any of the single letters (or the double letters) or a letter of any of several groups of letters turning up on a spin of the wheel. The game also provides for wagers on the chance of a given letter turning up on two or more consecutive turns of the wheel. A further wagering opportunity is provided for wagering upon the chance of a letter within a given word or words coming up on a turn of the wheel. The alphabetic positions on the wheel, and corresponding positions on the table, may be colored to allow players to place wagers on a color or colors, as desired.

It will be seen from a further review of the above-referenced patents and other prior art generally known to exist, however, that the prior art does not teach a roulette type game having certain mechanical means for accelerating a roulette ball from a non-energetic state to an energetic state for launching the roulette ball upon a roulette wheel. More particularly, the prior art appears to be silent on a roulette wheel apparatus comprising a pinball type roulette ball launcher or a suction-based ball accelerator for maximizing a roulette ball's potential energy, and harnessing the roulette ball's potential energy to deliver a kinetically energetic roulette ball to a roulette wheel for enhancing the gaming experience. The prior art thus perceives a need for a roulette ball delivery system of the type heretofore briefly introduced and otherwise not shown or taught by the prior art.

SUMMARY OF THE INVENTION

Accordingly, it is an object of the present invention to essentially provide a roulette apparatus having novel structure for delivering roulette balls to the surface as a means to enhance the roulette gaming experience. The underlying roulette game may be themed, such as a vibrant rainbow themed roulette game, or a Mah Johng type theme in which the theme(s) may be extended to enable one or more levels of so-called Mystery Jackpot prizes or awards. Depending on the underlying theme of the roulette game, the ball delivery system of the present invention may be designed for delivering one or more balls for a single round of roulette play. Further, the roulette balls may be delivered coaxially or multi-axially depending on the underling roulette theme.

To achieve these and other readily apparent objectives, the roulette apparatus of the present invention essentially provides a roulette apparatus for enabling and enhancing single or multi-ball roulette gaming and comprises a roulette wheel assembly, an optional ball-delivery tower, certain ball-delivery means, and certain optional wheel-monitoring means. The roulette wheel assembly preferably comprises a roulette wheel and wheel rotation means for rotating the roulette wheel about a substantially vertical wheel axis of rotation. The roulette wheel comprises a ball-receiving upper wheel surface, at least one ball-receiving track, and a wheel radius.

The ball-delivery tower preferably comprises a vertical tower support and a horizontal tower arm. The vertical tower support has lower and upper tower ends and extends substantially parallel to the wheel axis of rotation. The wheel radius preferably extends intermediate the lower tower end and the wheel axis of rotation. The horizontal tower arm extends toward the wheel axis of rotation from the upper tower end, and may further function to house certain wheel-monitoring means. It is contemplated that the wheel-monitoring means may well function to capture and relay video imagery of the upper wheel surface to certain peripheral video display means. The video display means may thus be positioned adjacent the multi-ball roulette apparatus for enabling players to view video of roulette gaming for enhancing the visual uptake of roulette gaming.

The ball-delivery means function to deliver one or more roulette balls to the roulette wheel and essentially comprise a ball inlet end, a ball outlet end, and ball-conducting conduit extending intermediate the ball inlet and ball outlet ends. The ball inlet end comprises certain ball-accelerating means. The ball-conducting conduit may preferably comprise a peak portion, which peak portion may extend through the vertical support portion of the ball-delivery tower intermediate the upper and lower tower ends. The ball outlet end may be further positioned intermediate the peak portion and the upper wheel surface and be properly aimed for directing conduit-conducted roulette balls into a ball-receiving track of the roulette wheel.

The ball-accelerating means impart initial ball kinetic energy to roulette ball(s) engaged thereby. The peak portion imparts maximum ball potential energy to roulette ball(s) positioned thereat. The total ball energy (i.e. the ball kinetic and ball potential energies combined) enables a certain final translational ball motion to roulette balls conducted through the ball-conducting conduit to the ball outlet end. As earlier alluded to, the ball outlet end, being properly positioned and aimed, functions to launch roulette balls upon the upper wheel surface via the ball-launching tracks. It is thus contemplated that the roulette apparatus of the present invention may well function to enable and enhance single or multi-ball roulette gaming.

While any number of ball-accelerating means may well function to impart sufficient ball energy to conduct a roulette ball through the ball-conducting conduit of the present invention, it is contemplated that the ball-accelerating means maybe defined by a spring actuable ball-collider (or a bank of ball-colliders) very much akin to conventional pinball type ball-launchers. It is contemplated that the ball-collider(s) may well function to imparting certain ball-accelerating impulses to roulette balls, which impulses provide sufficient kinetic energy to drive the roulette balls to the peak portion of the ball-conducting conduit (and beyond). Alternatively, it is contemplated that the ball-accelerating means may be defined by certain pressure reduction means, such as a suction source or vacuum source. The pressure reduction means essentially function to reduce the atmospheric pressure adjacent roulette balls via the ball-conducting conduit, which reduced atmospheric pressure functions to create a force for driving the roulette balls to the peak portion.

The upper wheel surface comprises ball-supporting sectors, which may preferably comprise select colorization, which select colorization may be selected from the color group consisting of rainbow colors: red, orange, yellow, green, blue, indigo, and violet. The sectors may also comprise or bear select alphabetic character indicia or other meaningful symbolic indicia, such as Mah Jong type Chinese characters and the like. The roulette balls and the ball-conducting conduit of the present invention may further comprise select colorization in keeping with the rainbow roulette notion.

It having been noted that visual enhancements abound in the present invention, it is further contemplated that the roulette apparatus of the present invention may further comprise certain tower-disguising means for disguising and/or otherwise enhancing the visual appeal of the ball-delivery tower. The tower-disguising means may preferably resemble a fanciful creature, which creature may well function to otherwise conceal or disguise the certain portions of the ball-conducting conduit and the ball-delivery tower. The tower-disguising means may further tie in with the underlying theme of the roulette game, as for example, a dragon-type fanciful creature might tie in with a Mah Jong—themed roulette game. Notably, the fanciful creature may also comprise a monitor-enabling window, however disguised, that is cooperable with the wheel-monitoring means for enabling players to view video of roulette gaming.

Other objects of the present invention, such as certain novel ball delivery methodology inherently taught by the construction of the present roulette apparatus, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of patent drawings:

FIG. No. 1 is a top perspective view of a preferred embodiment of the roulette apparatus of the present invention showing a roulette wheel assembly and a ball delivery tower.

Figure 1:
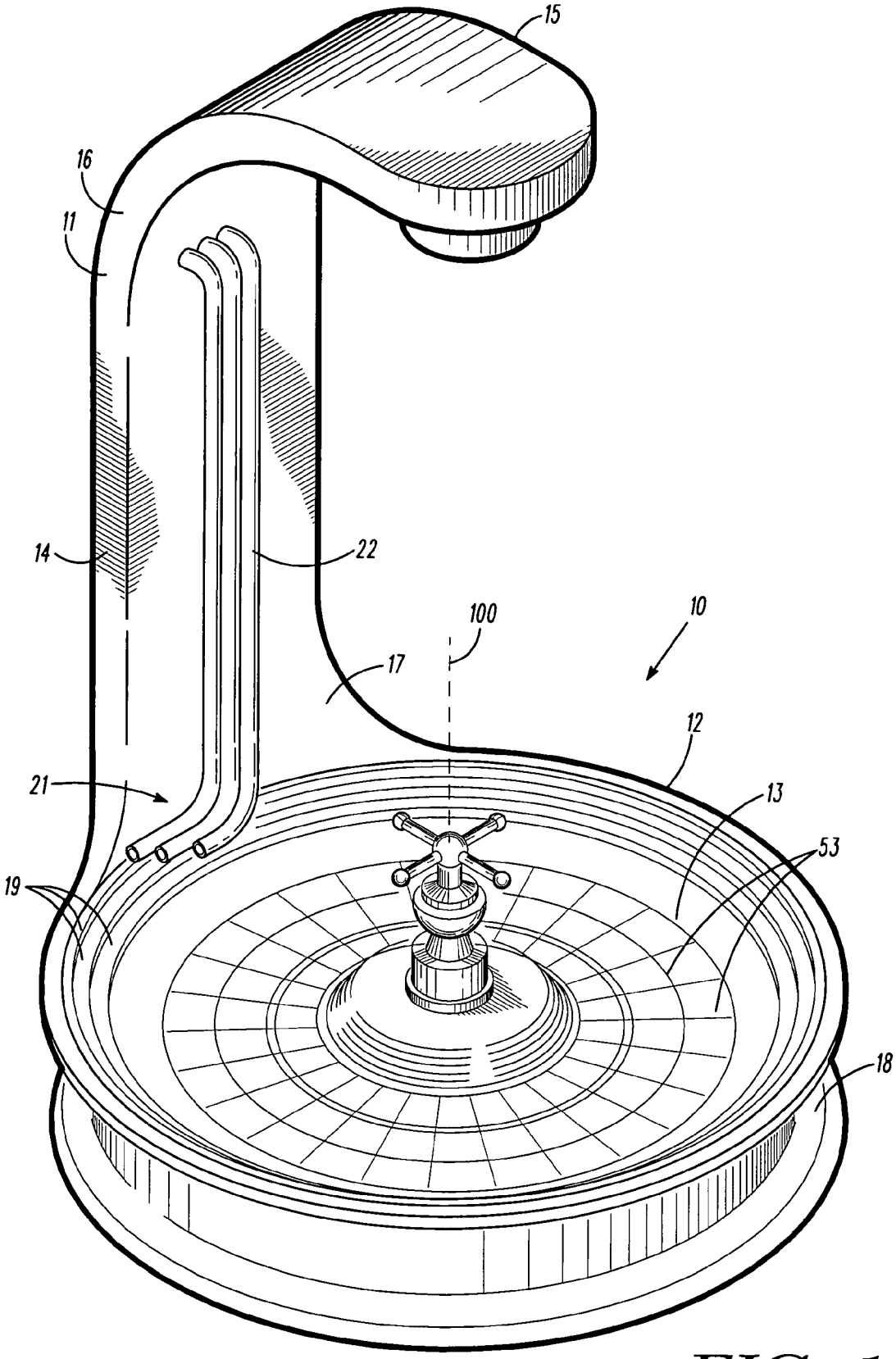
Figure 2:
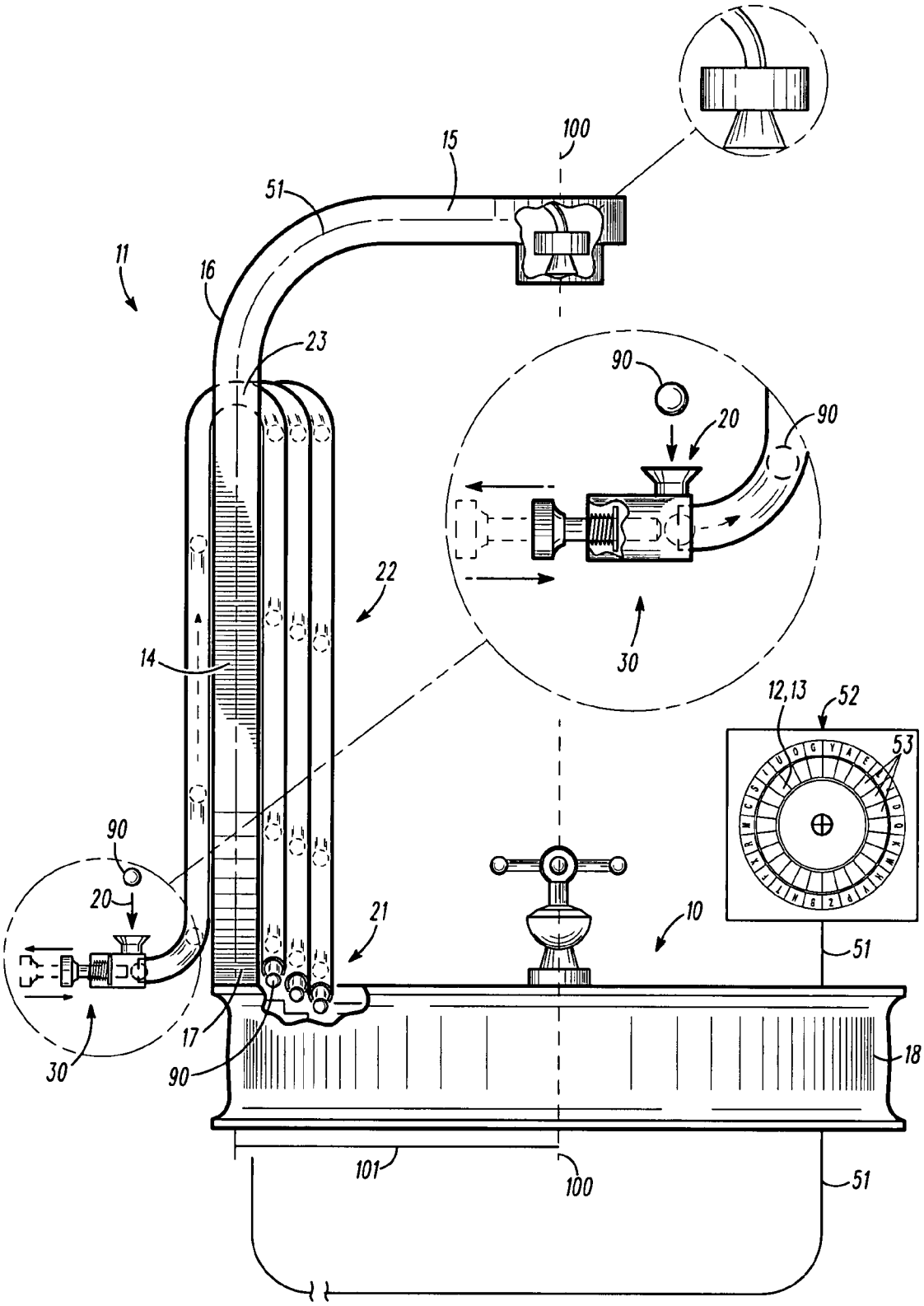
Figure 3:
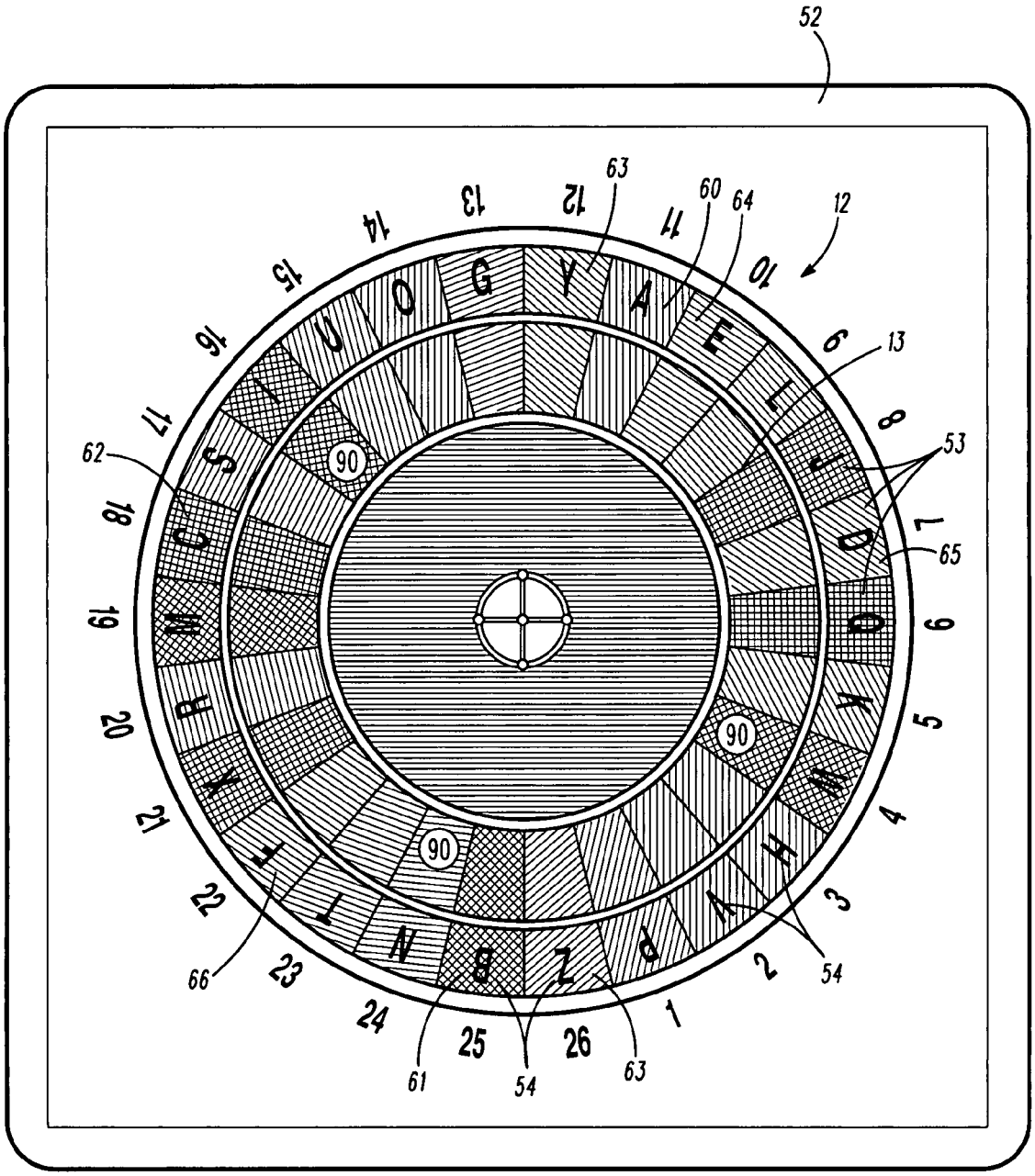
Figure 4:
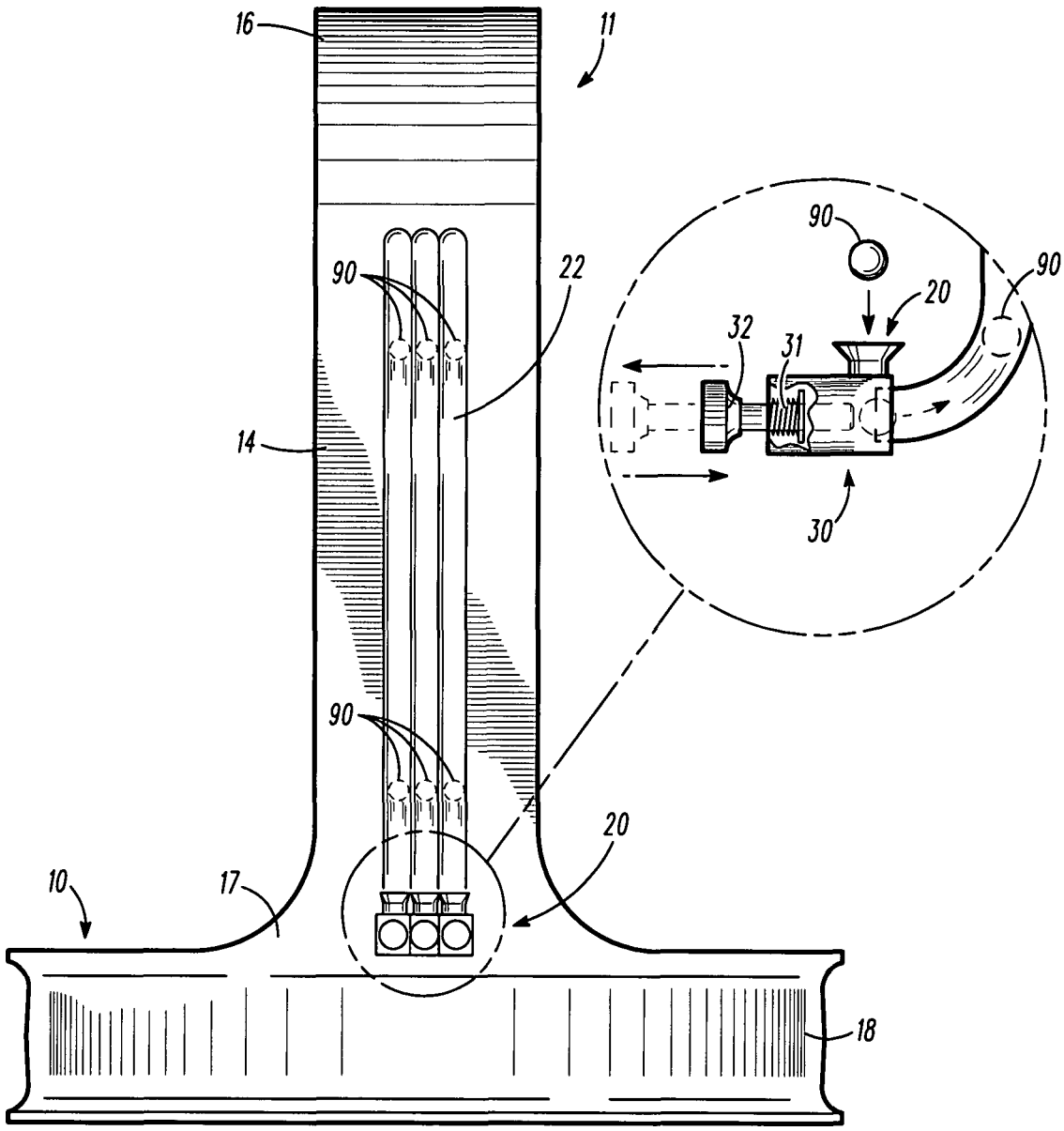
Figure 5:
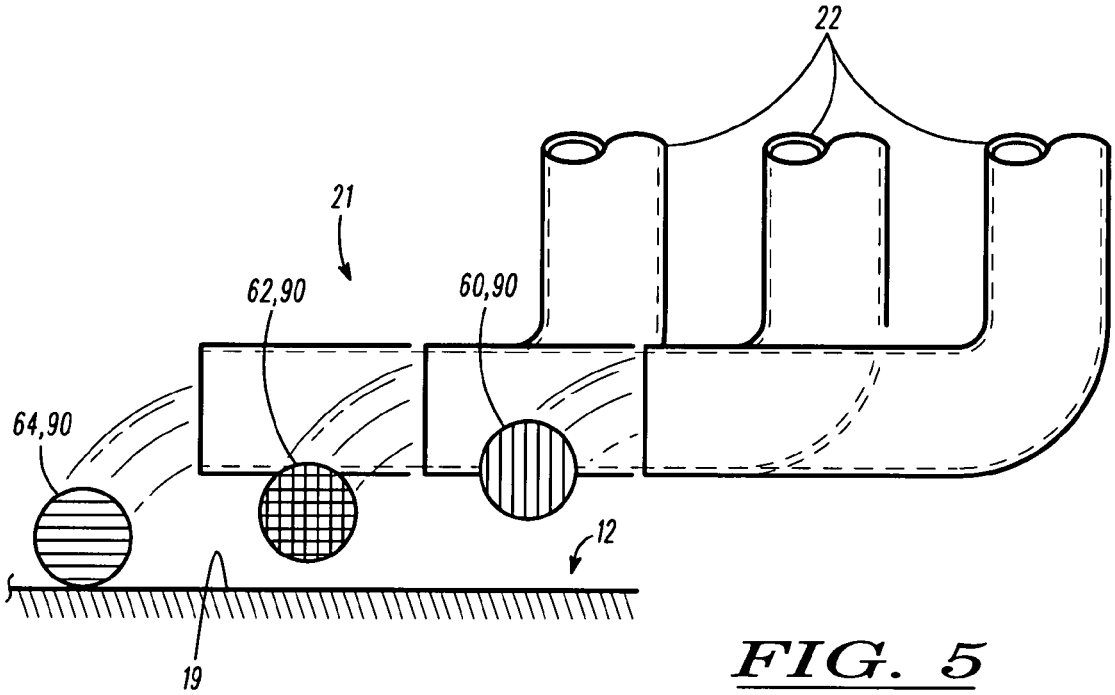
Figure 6:
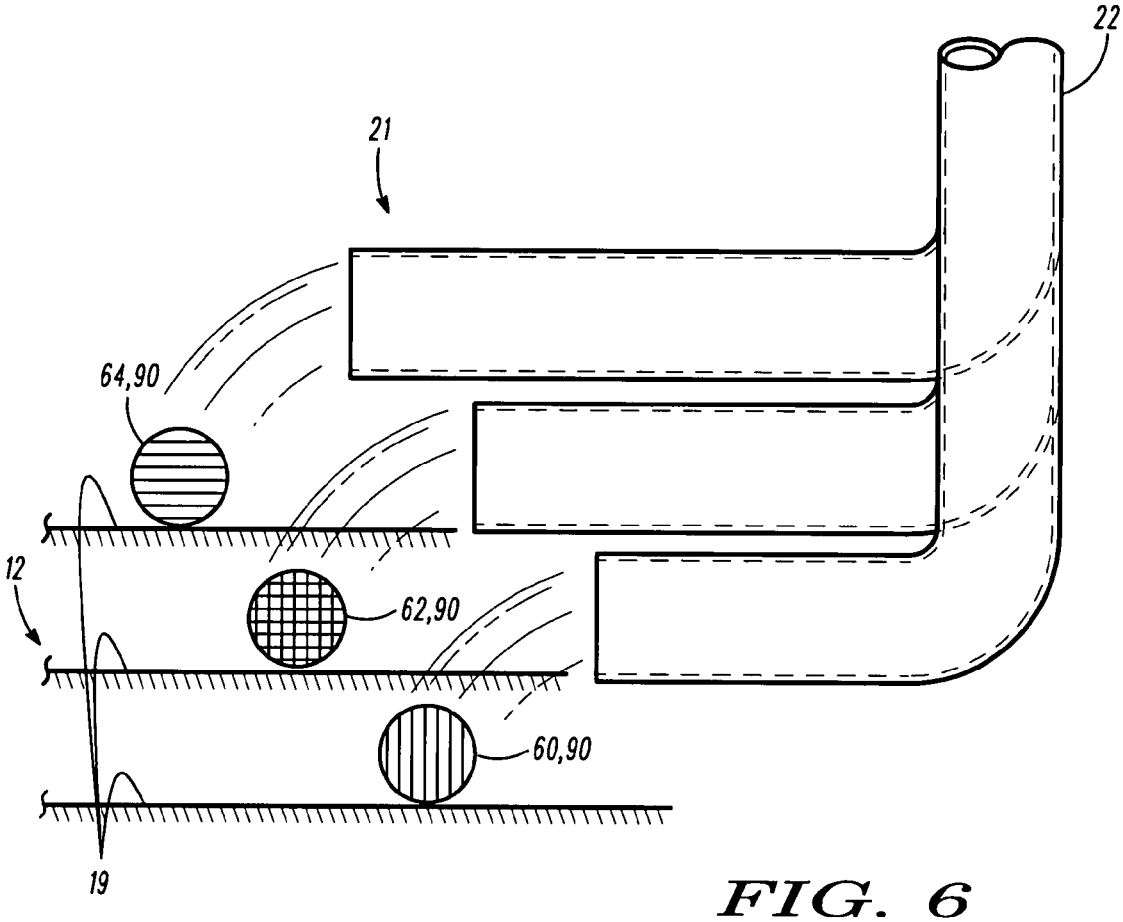
Figure 7:
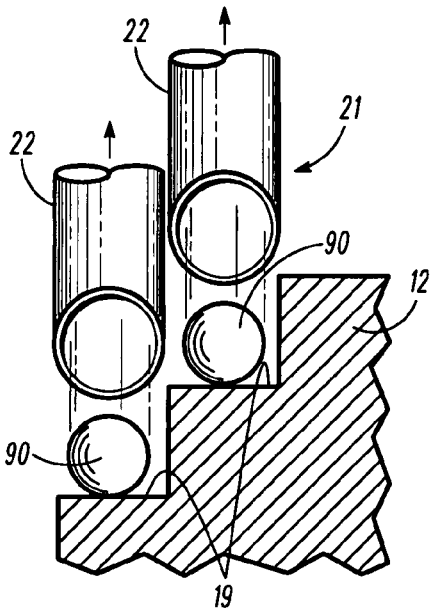
Figure 8:
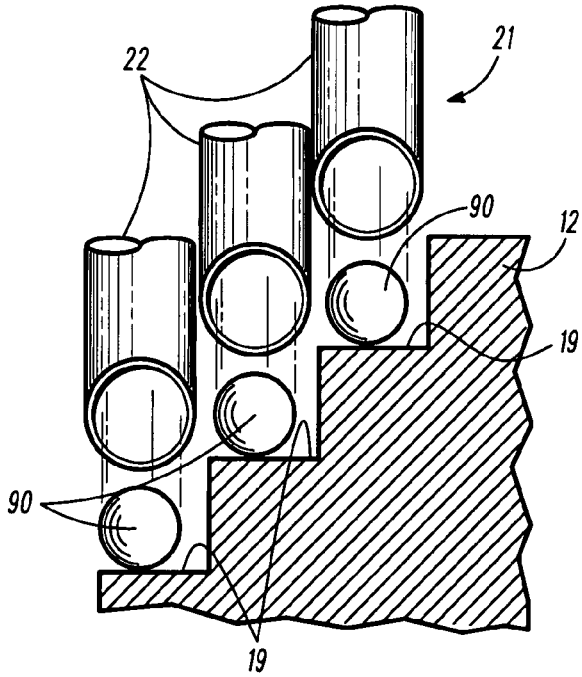
Figure 9:
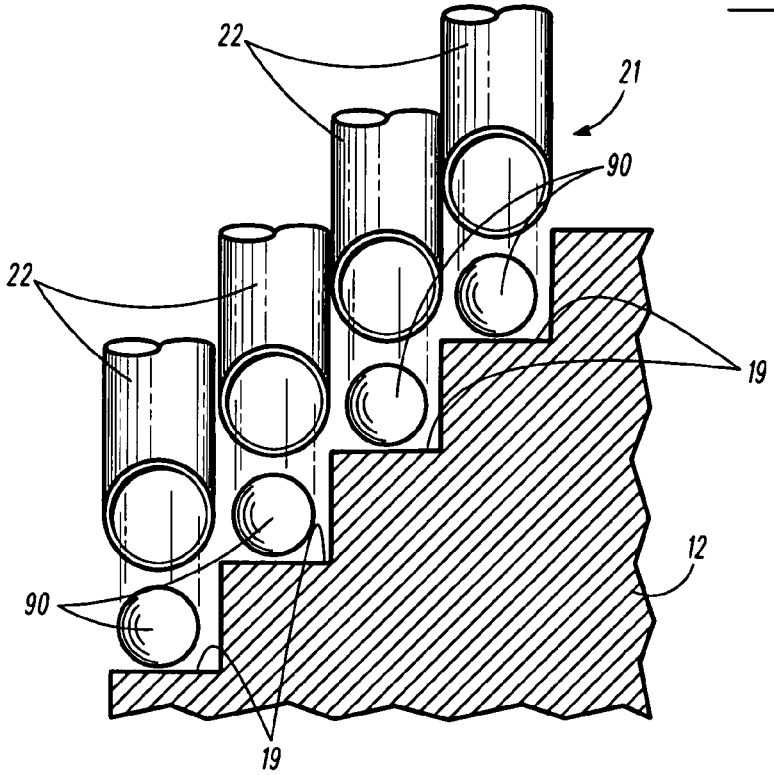
Figure 10:
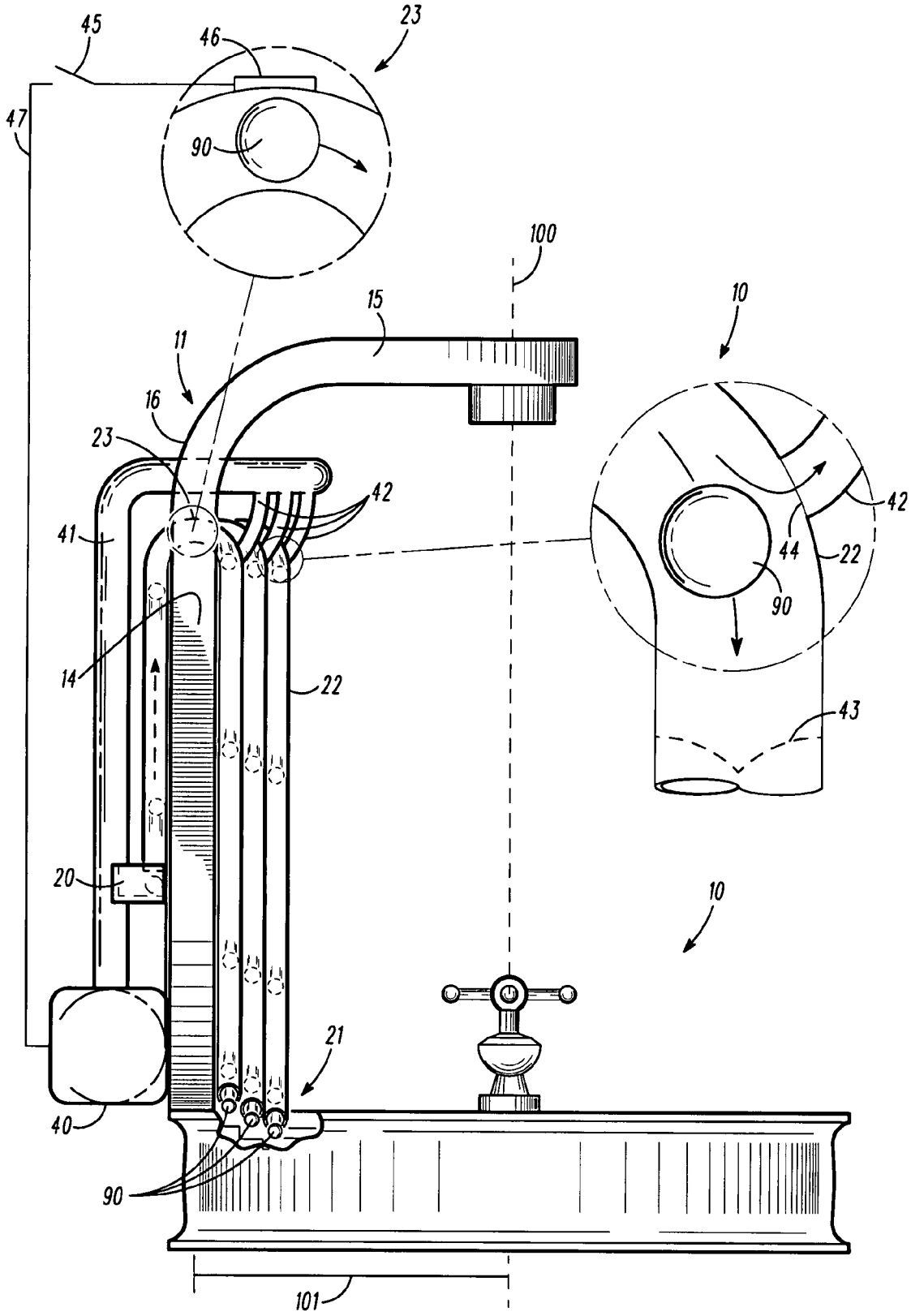
Figure 11:
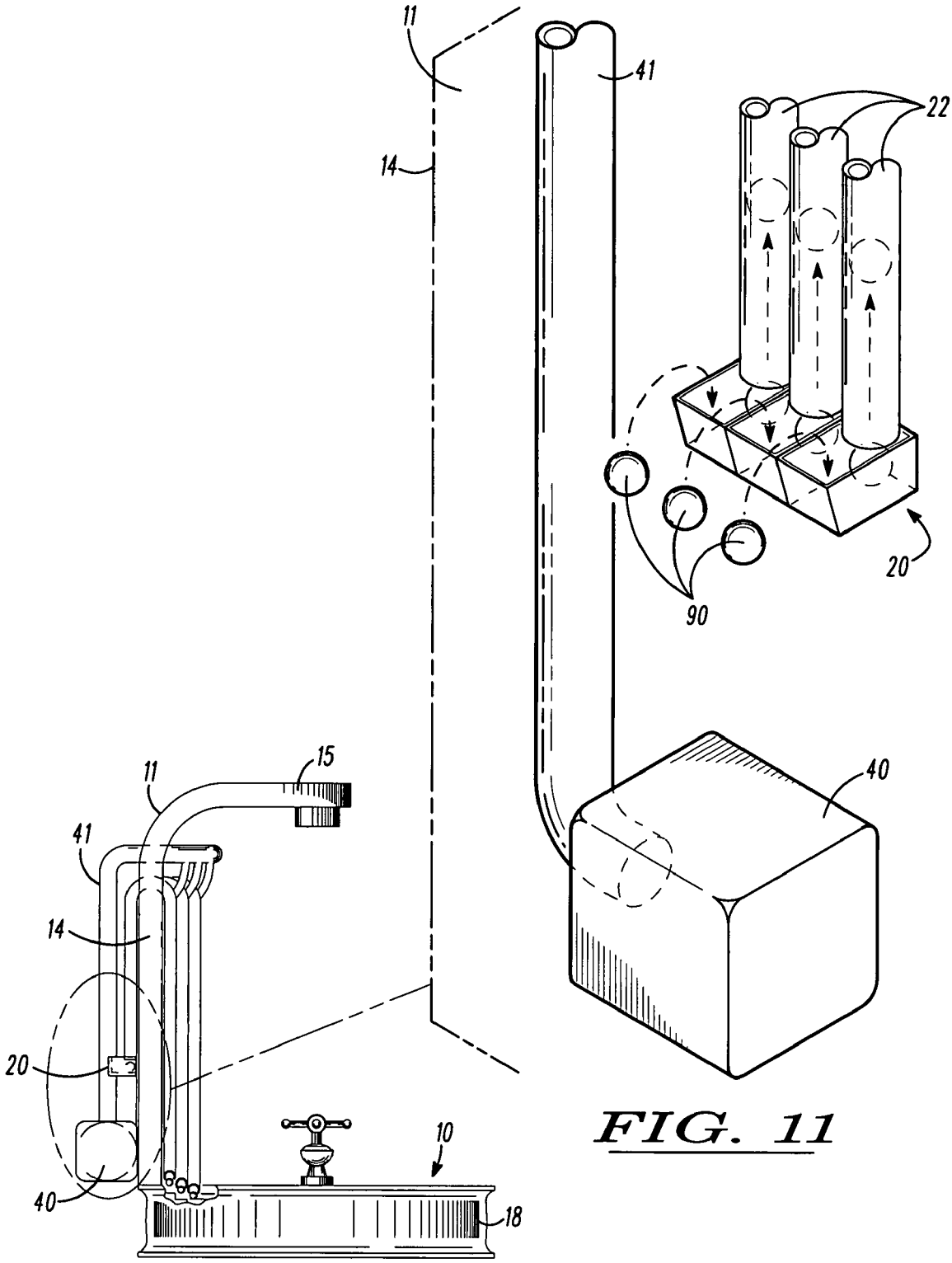
Figure 12:
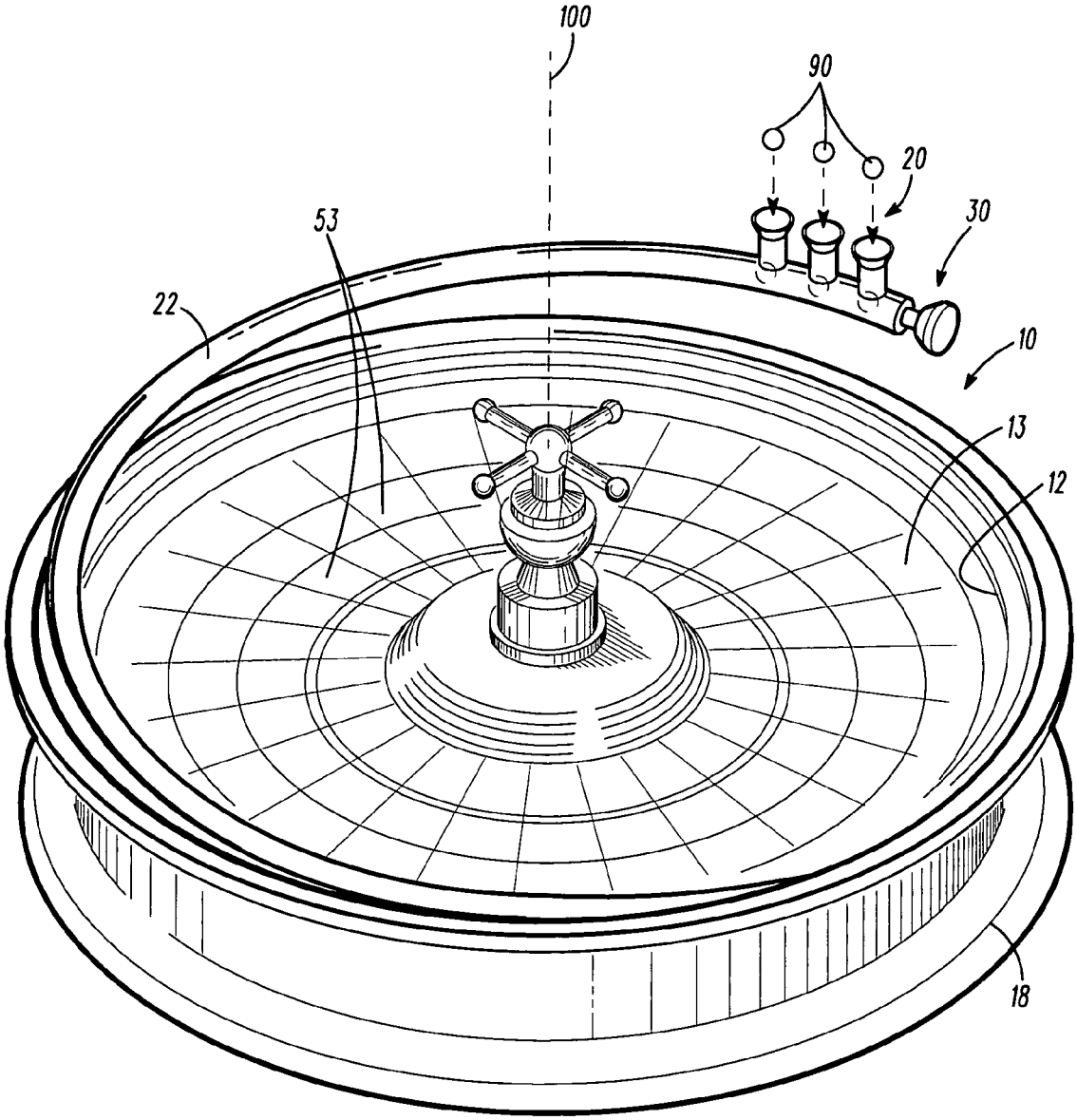
Figure 13:
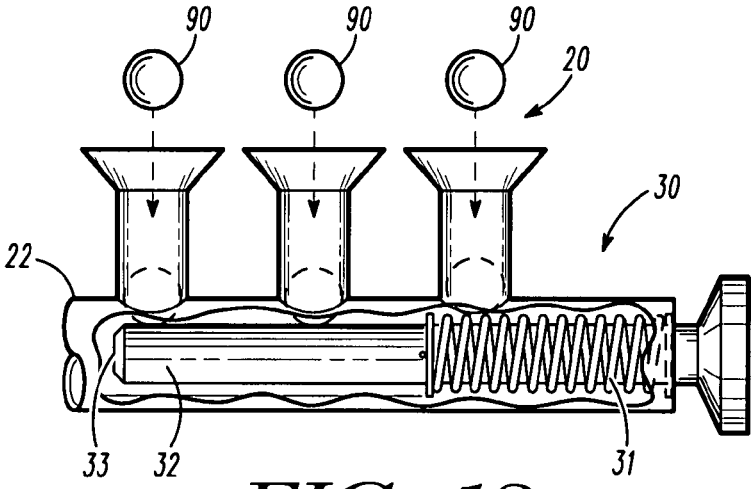
Figure 14:
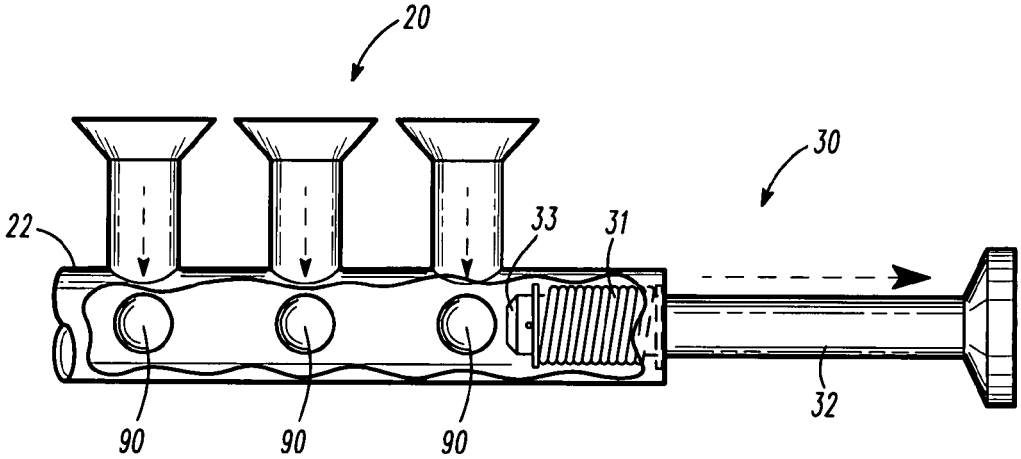
Figure 15:
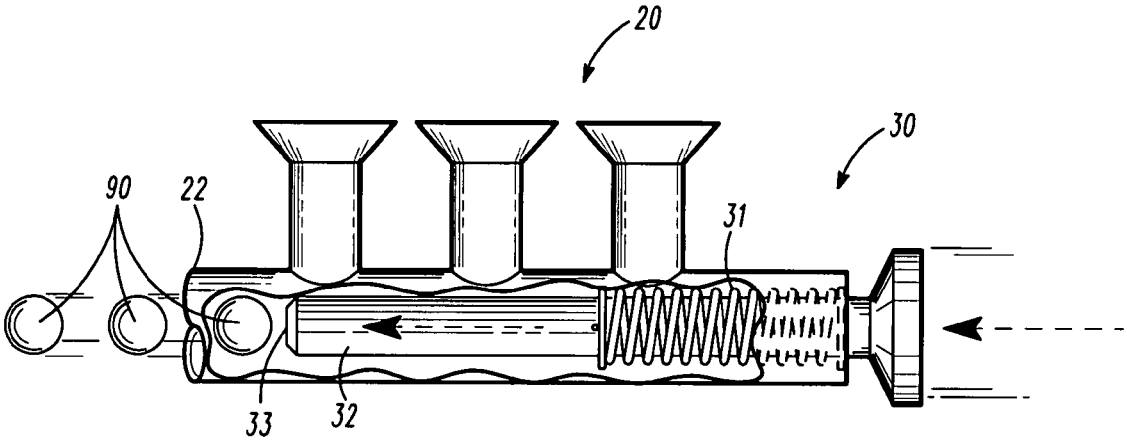
Figure 16:
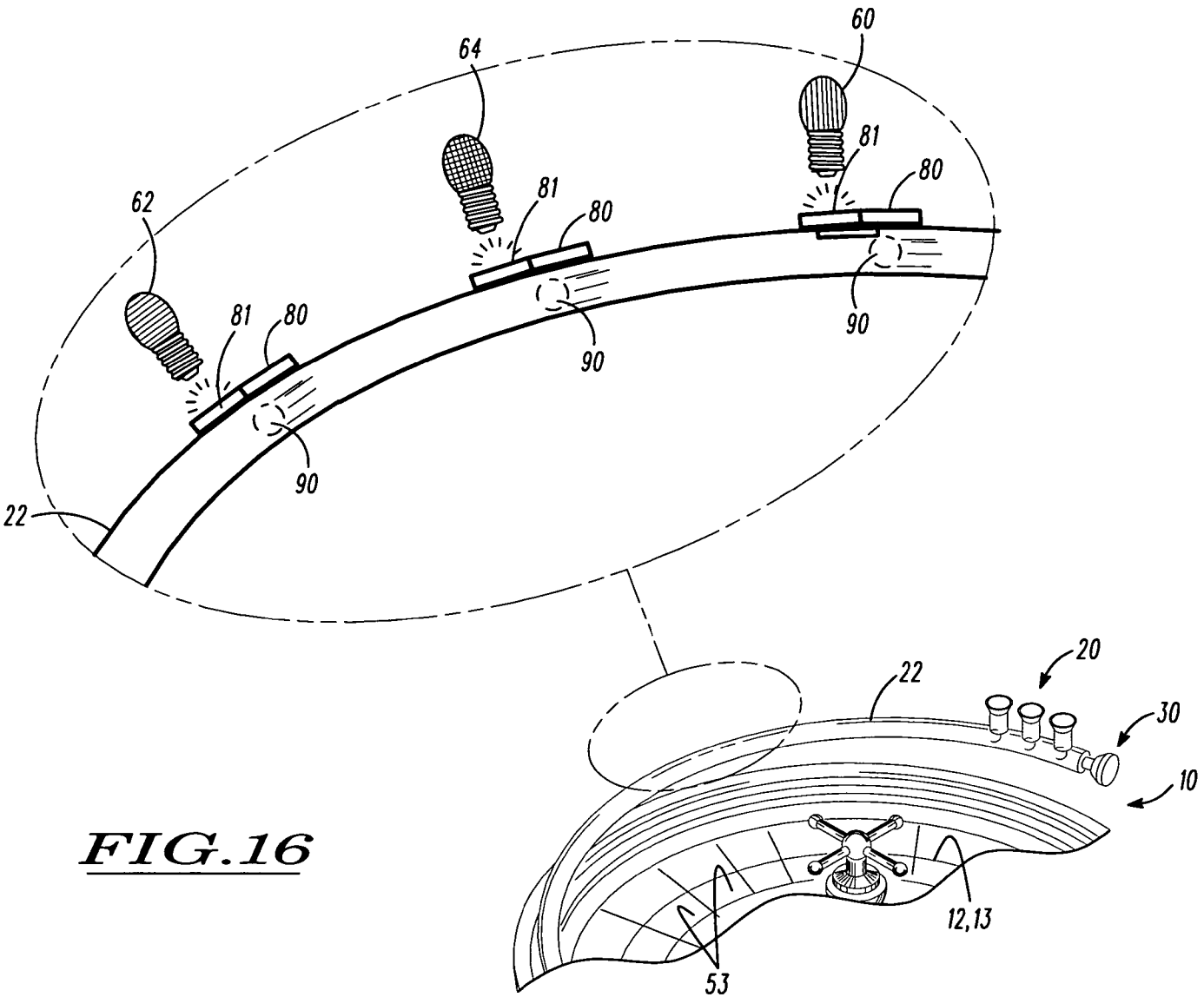
Figure 17:
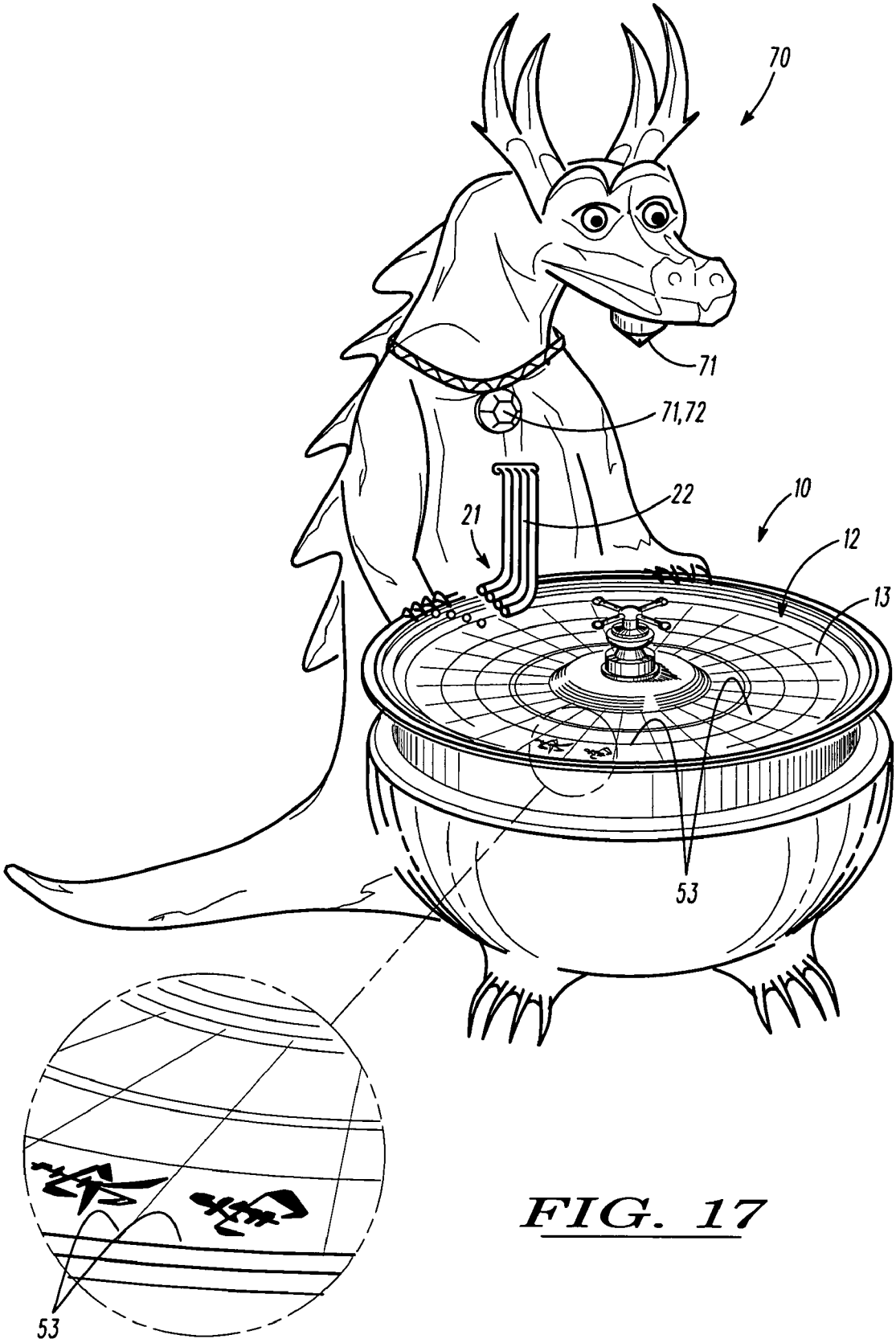
Figure 18:
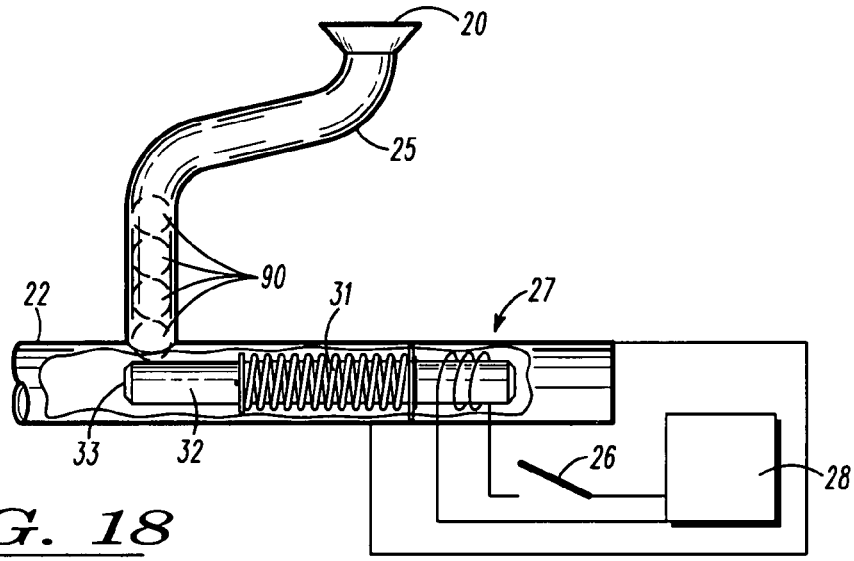
Figure 19:
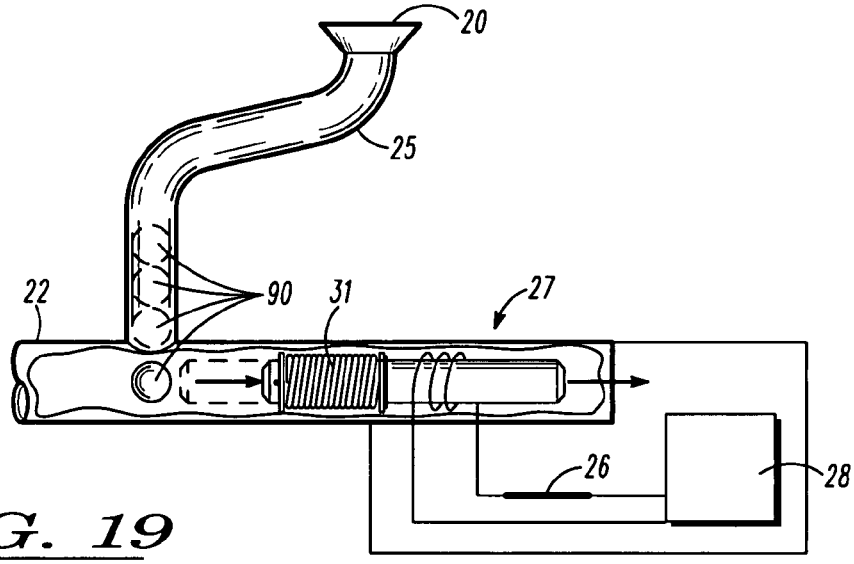
Figure 20:
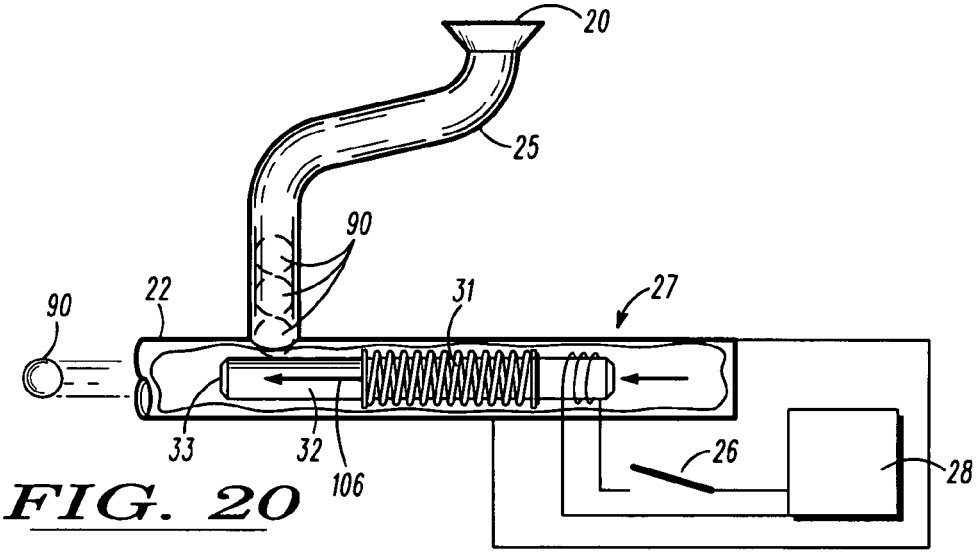
Figure 21:
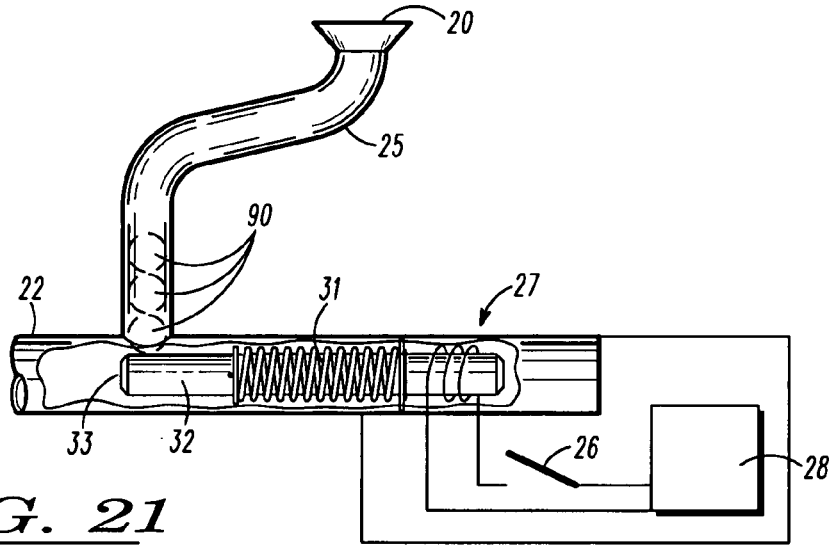
Figure 22:
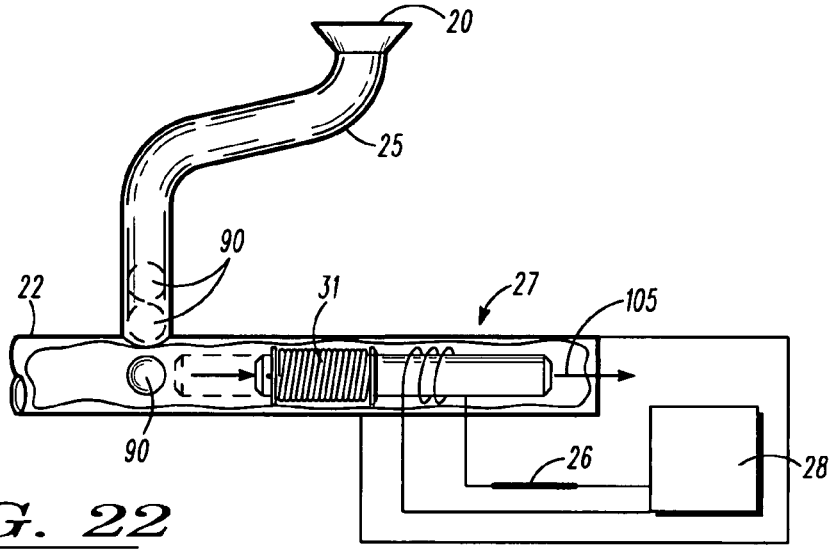
Figure 23:
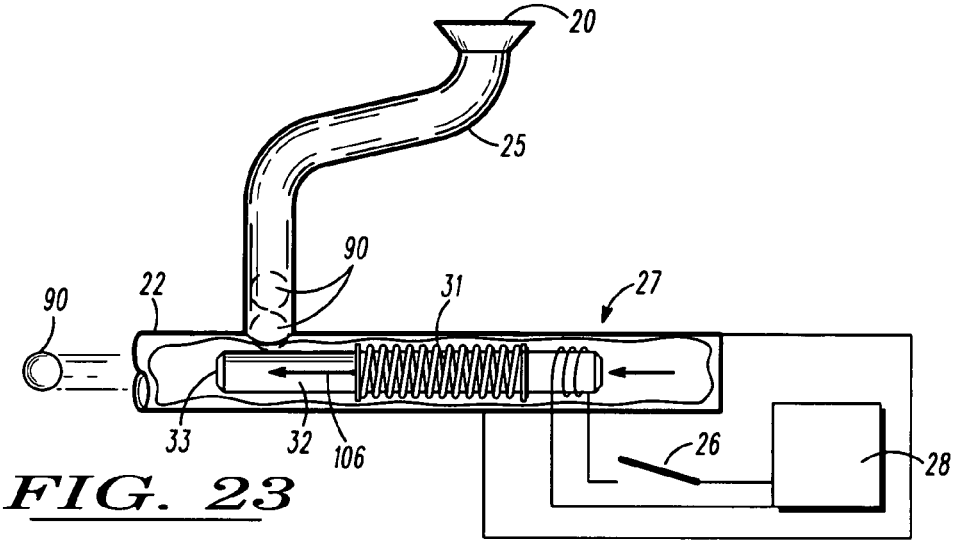

FIG. No. 2 is a player side view depiction of the roulette apparatus otherwise shown in FIG. No. 1 with (1) certain parts broken away to show a video camera and the ball outlet, (2) an enlarged sectional view of the ball inlet, and (3) a video display unit.

FIG. No. 3 is an enlarged view of the video display unit otherwise shown in FIG. No. 2.

FIG. No. 4 is a croupier side view of the roulette apparatus otherwise shown in FIG. No. 1 with an enlarged sectional player side view depiction of the ball inlet.

FIG. No. 5 is a fragmentary enlarged side view depiction of a first ball outlet of the roulette apparatus depicting a coplanar multi-ball launching configuration.

FIG. No. 6 is a fragmentary enlarged side view depiction of a second ball outlet of the roulette apparatus depicting a stepped multi-ball launching configuration.

FIG. No. 7 is a fragmentary cross-sectional side view of a portion of a first roulette wheel of the present invention depicting two character-identifying balls being launched into two ball-launching track rings from a first ball outlet.

FIG. No. 8 is a fragmentary cross-sectional side view of a portion of a second roulette wheel of the present invention depicting three character-identifying balls being launched into three ball-launching track rings from a second ball outlet.

FIG. No. 9 is a fragmentary cross-sectional side view of a portion of a third roulette wheel of the present invention depicting four character-identifying balls being launched into four ball-launching track rings from a third ball outlet.

FIG. No. 10 is a player side view depiction of a first alternative roulette apparatus of the present invention with (1) certain parts broken away to show the ball outlet, and (2) an enlarged sectional view of a junction intermediate suction conduit and ball-conducting conduit of the present invention.

FIG. No. 11 is a reduced player side view depiction of the first alternative roulette apparatus otherwise shown in FIG. No. 10 with a fragmentary enlarged perspective view of a suction source, suction conduit, and a second ball inlet of the present invention.

FIG. No. 12 is a top perspective view of a second alternative roulette apparatus of the present invention showing a roulette wheel assembly, a ball-conducting conduit, and a multi-ball collider or collision assembly.

FIG. No. 13 is an enlarged fragmentary side view depiction of the multi-ball collider otherwise shown in FIG. No. 12 depicting three roulette balls being received in three ball inlets with certain parts broken away to show the spring-actuable plunger of the multi-ball collider is a relaxed equilibrium state.

FIG. No. 14 is an enlarged fragmentary side view depiction of the multi-ball collider otherwise shown in FIG. No. 12 depicting three roulette balls being received in the ball-conducting conduit with certain parts broken away to show the spring-actuable plunger of the multi-ball collider is an actuated state with maximized plunger potential energy.

FIG. No. 15 is an enlarged fragmentary side view depiction of the multi-ball collider otherwise shown in FIG. No. 12 with certain parts broken away to show the spring-actuable plunger of the multi-ball collider returning to the relaxed equilibrium state and impulsing the three roulette balls into the ball-conducting conduit.

FIG. No. 16 is fragmentary top perspective view of the second alternative roulette apparatus otherwise shown in FIG. No. 12 with a fragmentary section of the ball-conducting conduit enlarged therefrom to diagrammatically depict ball-sensing and conduit-illumination means.

FIG. No. 17 is a perspective view of the roulette apparatus of the present invention with certain fanciful tower-disguising means disguising the ball-delivery tower and a fragmentary enlarged section view of the upper wheel surface.

FIG. No. 18 is an enlarged fragmentary side view depiction of an alternative multi-ball collider of the present invention depicting a prelaunch, first step of a launch sequence with four roulette balls housed in a ball magazine with a solenoidal ball collider in an open switch, spring-relaxed, computer-controlled state.

FIG. No. 19 is an enlarged fragmentary side view depiction of the alternative multi-ball collider otherwise depicted in FIG. No. 18 depicting a second step of the launch sequence with three roulette balls housed in the ball magazine with a single ball received in a ball chamber of the ball-conducting conduit, and the solenoidal ball collider in a closed switch, spring-actuated, computer-controlled state.

FIG. No. 20 is an enlarged fragmentary side view depiction of the alternative multi-ball collider otherwise depicted in FIG. No. 18 depicting a third step of the launch sequence with three roulette balls housed in the ball magazine with the single chamber-delivered ball being launched into the ball-conducting conduit, the solenoidal ball collider returning to an open switch, spring-relaxed, computer-controlled state.

FIG. No. 21 is an enlarged fragmentary side view depiction of the alternative multi-ball collider otherwise shown in FIG. No. 18 depicting the pre-launch, first step of the launch sequence with three roulette balls housed in a ball magazine and the solenoidal ball collider in an open switch, spring-relaxed, computer-controlled state.

FIG. No. 22 is an enlarged fragmentary side view depiction of the alternative multi-ball collider otherwise depicted in FIG. No. 18 depicting a second step of the launch sequence with two roulette balls housed in the ball magazine with a single ball received in the ball chamber of the ball-conducting conduit, and the solenoidal ball collider in a closed switch, spring-actuated, computer-controlled state.

FIG. No. 23 is an enlarged fragmentary side view depiction of the alternative multi-ball collider otherwise depicted in FIG. No. 18 depicting a third step of the launch sequence with two roulette balls housed in the ball magazine with the single chamber-delivered ball being launched into the ball-conducting conduit, the solenoidal ball collider returning to an open switchy, spring-relaxed, computer-controlled state.

DETAILED DESCRIPTION OF THE PREFERRED EMBODIMENT(S)

Referring now to the drawings, the preferred practice of the present invention generally involves or concerns a roulette apparatus whereby the roulette ball(s) 90 may be delivered to the roulette wheel assembly 10 by way of a ball-delivery system. While the roulette balls 90 must be initially manually positioned adjacent a ball inlet 20 of the present roulette apparatus, the mechanisms and structure of the present roulette apparatus provide roulette players with new and stimulating roulette gaming visuals that are thought to enhance the overall roulette gaming experience. Moreover, after the roulette balls 90 are initially (and manually) accelerated by the croupier, the roulette balls 90, upon exiting the ball outlet 21, appear as though they are self-launching.

The ball-delivery system of the present invention may be utilized to deliver one or more roulette balls 90 to the roulette wheel assembly 10 depending on how many roulette balls 90 the underlying roulette theme may require. For example, should the underlying roulette theme require the formation of syllables comprising two, three, or four letters, the ball-delivery system of the present invention may thus comprise two, three, or four ball-conducting pathways or conduit for guiding energetic (translating) roulette balls 90 to the roulette wheel 12 as well as certain means for imparting translational motion or to or otherwise accelerating the roulette balls 90 for enabling effective delivery of said balls 90 to the roulette wheel 12.

The preferred practice of the present invention thus contemplates a multi-ball roulette apparatus for enabling and enhancing multi-ball roulette gaming, which multi-ball roulette apparatus preferably comprises a roulette wheel assembly 10 as illustrated and referenced in FIG. Nos. 1-4, 10-12, 16, and 17; a ball-delivery tower 11 as illustrated and referenced in FIG. Nos. 1, 2, 4, 10, and 11; certain ball-delivery means for effectively delivering multiple roulette balls 90 to (and launching multiple roulette balls 90 upon) the roulette wheel assembly 10; and certain means for monitoring the roulette gaming action upon the roulette wheel assembly 10.

The roulette wheel assembly 10 of the present invention is essentially akin to more traditional roulette wheels in basic structure and thus preferably comprises a roulette wheel 12 as illustrated and referenced in FIG. Nos. 1-3, 5-9, 12, 16, and 17; and certain wheel rotation means for rotating the roulette wheel 12 about a wheel axis of rotation as referenced at 100 in FIG. Nos. 1-3, 10, and 12. From a general consideration of the state of the art, as well as from an inspection of the noted figures, it will be readily understood that the wheel axis of rotation 100 is preferably and substantially vertical. The roulette wheel 10 preferably comprises a ball-receiving or ball-supporting upper wheel surface 13 with a plurality of ball-receiving or ball-supporting sectors 53 as illustrated and referenced in FIG. Nos. 1-3, 12, 16, and 17; and a wheel radius 101 as referenced in FIG. Nos. 2 and 10.

The roulette wheel assembly 10 may preferably comprise a plurality of evenly spaced, radially inward, ball-receiving sectors 53 as illustrated and referenced in the noted figures; and a plurality of radially outward sphere-launching track rings 19 as generally illustrated and referenced in FIG. Nos. 1, 5-9, and 12. It may be seen from an inspection of the noted figures that track rings 19 may be preferably stepped in order to guide roulette balls 90 initially in radially outward adjacency to radially inward sectors 53 to enhance random deployment from the tracks or rings 19 into various sectors 53. Further, depending on the number of balls 90 to be utilized or characters 54 to be identified, it is contemplated that the number of track rings 19 may preferably equal the number of balls 90 as a means to enhance random deployment as may be seen from a general consideration of FIG. Nos. 7-9.

It is further contemplated that each ball-receiving sector 53 may preferably comprise a colored superior sector surface, each of which surfaces preferably further bear a select alphabetic or meaningful symbolic wheel-based character 54. As may be seen from an inspection of FIG. No. 3, a plurality of colors is represented as depicted by various types of hatch markings. For example, the Roman alphabetic characters Y and Z are preferably accompanied by Green 63 coloration as depicted by hatch markings designated as green under United States Patent and Trademark Office rules of practice with regard to color depictions. Similarly, the Roman alphabetic characters A, H, O, and V are preferably accompanied by a Red 60 coloration; the Roman alphabetic characters B, I, M, and W are preferably accompanied by an Orange 61 coloration; the Roman alphabetic characters C, J, Q, and X are preferably accompanied by a Yellow 62 coloration; the Roman alphabetic characters E, L, R, and S are preferably accompanied by a Blue 64 coloration; the Roman alphabetic characters D, K, P, and U are preferably accompanied by an Indigo 65 coloration; and the Roman alphabetic characters F, G, N, and T are preferably accompanied by a Violet 66 coloration. The noted colors may thus comprise or denote the popular mnemonic ROY (G.) BIV for the optical spectrum or rainbow of colors. Similarly, when a plurality of roulette balls 90 are used in combination with the roulette apparatus of the present invention, the roulette balls 90 may preferably comprise select colorization. In this regard, the reader is directed to FIG. Nos. 5 and 6, which figures depict a roulette ball 90 with Red 60 coloration, a roulette ball 90 with Blue 64 coloration, and a roulette ball 90 with Yellow 62 coloration.

The ball-delivery tower 11 preferably comprises a substantially vertical tower support portion 14 as illustrated and referenced in FIG. Nos. 1, 2, 4, 10, and 11; and a tower arm 15 (which may be substantially horizontal or have a horizontal component) as illustrated and referenced in FIG. Nos. 1, 2, 10, and 11. The tower support portion 14 preferably comprises a vertical dimension greater in magnitude than the vertical dimension of the roulette wheel 12 and notably has an upper tower end 16 and a lower tower end 17. The lower tower end 17 may preferably be integrally formed with a wheel-retaining base 18 so as to visually effect a unitary roulette apparatus structure, and the upper tower end 16 may preferably curve into or terminate at the horizontal arm portion or tower arm 15. The tower support portion 14 may further preferably extend substantially parallel to the wheel axis of rotation 100 with the wheel radius 101 effectively extending intermediate the lower tower end 17 and the wheel axis of rotation 100 for uniformly distancing the tower support portion 14 from the wheel axis of rotation 100.

In the preferred embodiment, the tower arm 15 may preferably extend toward the wheel axis of rotation 100 from the upper tower end 16 and terminate in superior adjacency to the center of the roulette wheel 12 with a curved end such that the radius of the curved end intersects the wheel axis of rotation 100 so as to enhance the aesthetics of the roulette apparatus and provide an aesthetically pleasing vantage point for the wheel-monitoring means. In this last regard, it is contemplated that the wheel-monitoring means or means for monitoring the roulette gaming action may preferably be housed within the terminal end of the tower arm 15.

The wheel-monitoring means may well function to capture and relay video imagery of the upper wheel surface 13 to certain peripherally located video display means. In other words, certain video display means, such as a video monitor 52 or similar other video display unit may be positioned adjacent the roulette apparatus for enabling players or gamers to view video of roulette gaming as generally and comparatively depicted and referenced in FIG. Nos. 2 and 3. The wheel-monitoring means may thus be defined by a video camera 50 cooperable with certain means for transmitting video signals to the video display means (such as circuitry 51 or wireless communication means), such as the aforementioned video monitor 52. The video camera 50 may be housed within the tower arm 15 (and the circuitry may be housed within the ball-delivery tower 11) and positioned so as to capture video imagery of roulette ball(s) 90 as they launch upon the upper wheel surface 13 and eventually fall into or otherwise identify character and/or color bearing, ball-receiving or ball-supporting sectors 53 of the roulette wheel assembly 10. It may be seen from an inspection of FIG. No. 3, for example, that three roulette balls 90 are depicted as having landed and thus identified the three Roman alphabetic characters: W.I.N. with color backgrounds: Orange 61, Orange 61, and Violet 66, respectively.

It is contemplated that the ball-delivery system of the present invention essentially functions to deliver one or more roulette balls 90 to the roulette wheel assembly 10, and may be preferably defined as comprising a ball inlet or ball inlet end 20 as illustrated and referenced in FIG. Nos. 2, 4, and 10-16; a ball outlet or ball outlet end 21 as illustrated and referenced in FIG. Nos. 1, 2, 5, 6, 9-11, and 17; and certain ball-conducting conduit 22 extending intermediate the ball inlet end 20 and ball outlet end 21 as illustrated and referenced in FIG. Nos. 1, 2, 4-6, and 9-17. The ball inlet end 20 may preferably comprise or be cooperatively associated with certain mechanical, manually-loadable or manually-actuable, ball-accelerating means. It is contemplated that the mechanical ball-accelerating means of the present invention may be preferably defined by (1) certain ball-collisions means as definable by one or more spring-actuable ball-colliders 30 or ball-launchers as generally illustrated and referenced in FIG. Nos. 2, 4, and 12-16; or alternatively defined by (2) certain pressure reduction means, such as a suction source 40 or vacuum source (and associated conduit 41) as generally and generically illustrated and referenced in FIG. Nos. 10 and 11.

It may be seen from an inspection of the noted figures that the ball-colliders or ball-collision assemblies 30 of the present invention are akin to more conventional pinball type ball-launching assemblies. In this regard, it is noted that a conventional pinball is typically on the order of about 1.0625 inches in diameter (about 3 cm) and is constructed from stainless steel that weighs about 2.8 ounces (80 g). The roulette ball 90, by contrast, is of lighter weight and of smaller dimension. Roulette balls 90 are typically on the order of 0.5 inches (1.25 cm) in diameter and are typically constructed from polymeric materials, and thus the ball-collider or ball-collision assemblies 30 of the present invention may be designed to as to impart ball-accelerating impulses of significantly lesser magnitude as compared to pinball-launching ball-colliders. In other words, the spring-actuable collision assembly (comprising a compression spring 31 and a plunger 32 with an elastic-collision-enabling tip 33 as illustrated and referenced in FIG. Nos. 13-15) required by the present invention should set forth or impart a reduced impulse for initially propelling and imparting kinetic energy to the deliverable roulette ball 90.

In this last regard, it will be further seen that the initial impulse provided by the ball-accelerating means as defined by the ball-collider 30 should be designed to impart sufficient kinetic energy to the deliverable roulette ball 90 so that the roulette ball 90 may reach a maximized peak portion 23 of the ball-conducting conduit 22 as depicted and referenced in FIG. Nos. 2 and 10. In other words, at the ball inlet end 20, an impulse provided by the ball-collider 30, should impart maximized initial kinetic energy to the roulette ball 90. As the roulette ball 90 travels or conducts via the ball-conducting conduit 22, it reaches peak portion 23 at which its potential energy is maximized (it being noted that it may also have some residual kinetic energy). The requisite ball-accelerating impulse provided by the ball-collider 30 of the present invention will ultimately depend on the specifications of the ball-delivery tower 11 and the vertical tower support portion 14, which functions to support the peak portion 23, as well as the material specifications of the chosen roulette ball 90.

Should the ball-accelerating means be alternatively defined by certain pressure reduction means, it is contemplated that the means may effectively function to reduce the atmospheric pressure adjacent the roulette ball(s) 90 by way of the ball-conducting conduit 22. In other words, the pressure should be reduced on the far side of the roulette ball(s) 90 as compared to the ball inlet end 20 for forcing the roulette ball(s) 90 to the peak portion 23. In this regard, it is noted that pressure is equal to the force per unit area. If the pressure behind a roulette ball 90 is reduced, the pressure in front of a roulette ball 90 will be effectively increased. The relative increase in front side or inlet side pressure will force the roulette ball 90 toward the pressure-reduced area, thereby conducting the roulette ball(s) 90 through the ball-conducting conduit 22.

In this last regard, the reader is directed to FIG. Nos. 10 and 11. From an inspection of the noted figures, it will be noted that the pressure reduction means contemplated by the present invention is generically represented by a suction source 40 or vacuum machine. The suction source 40 may comprise suction conduit 41 cooperatively associated with the ball-conducting conduit 22 for creating reduced pressure within the ball-conducting conduit 22 for forcefully conducting the roulette ball(s) 90 through the ball-conducting conduit 22. Notably, the suction conduit 41 terminates "behind" or past the peak portion 23 such that the ball momentum may carry the conducting roulette ball(s) 90 past the suction conduit terminus 42. The ball-conducting conduit 22 may be outfitted with certain valve means (as at 43) for preventing air flow via the ball outlet end 21 and thus for effectively enhancing the pressure-reducing function of the suction source 40 and conduit 41. Notably, the conduit terminus may further comprise certain screening 44 to prevent the roulette ball 90 from otherwise being directed into suction conduit 41. Certain ball-sensing means (as at 44 in FIG. No. 10) may well function to interrupt operation of the suction source 40 (as for example by opening an operative circuit 47) to enable ball momentum to carry the roulette ball 90 through the ball-conducting conduit 22. It is contemplated that the ball-sensing means 46 may be positioned at the peak portion 23 for opening suction source switching means (as at 45) for interrupting the suction source 40. It is thus contemplated that the ball momentum as bolstered by the ball potential energy, the ball kinetic energy, and gravitational force will operate to impart the requisite translational motion to the roulette ball(s) 90 for properly launching the same into the sphere- or ball-launching tracks 19 or rings via the ball outlet end 21.

Notably, the peak portion 23 extends through the vertical tower support portion 14 of the ball-delivery tower 11, which structures 11 and 14 function to support the peak portion 23. Preferably, the peak portion 23 extends intermediate the upper and lower tower ends 16 and 17, and the ball outlet end 21 is positioned intermediate the peak portion 23 and the upper wheel surface 13. The ball-accelerating means of the present invention thus function to impart initial ball kinetic energy to the roulette ball(s) 90. The peak portion 23 positions the roulette ball(s) for imparting maximum ball potential energy. Together, the ball kinetic and ball potential energies imparting final translational ball motion to the roulette ball(s) 90 as the exit or outlet from the ball outlet end 21 as generally depicted in FIG. Nos. 1, 2, and 5-11. The ball outlet end 21 is preferably positioned in superior adjacency to the upper wheel surface 13 for launching the roulette ball(s) 90 into the sphere- or ball-launching tracks or rings 19 integrally formed with or upon the upper wheel surface 13. From an inspection of FIG. Nos. 5 and 6, it may be seen that the roulette ball(s) 90, upon exiting the ball outlet end 21, follow parabolic path into or onto the sphere- or ball-launching tracks 19. Notably, the ball outlet end 21 is positioned in superior adjacency to the tracks 19 such that sufficient distance extends intermediate the inferior most portion of the ball outlet end 21 and the upper surface of the respective track 19 so that the roulette ball(s) 90 may pass unimpeded under the ball outlet end 21 after making complete revolutions about the track(s) 19.

In keeping with the notion of providing visual enhancements to solicit a heightened or highly stimulating roulette gaming experience, it is further contemplated that the ball-conducting conduit 22 may preferably comprise certain ball-sensing means and certain conduit-illumination means, the ball-sensing means and conduit-illumination means being cooperable with one another for sensing the position of a conduit-conducting roulette ball 90 and illuminating that portion of the ball-conducting conduit 22 being traversed by the roulette ball 90. The illumination may thus follow or highlight the path of the roulette ball 90 as it travels through the length of the ball-conducting conduit 22. In this regard, the reader is directed to FIG. Nos. 12 and 16. From an inspection of the FIG. No. 16, in particular, it may be seen that the ball-sensing means may be defined by ball sensors 80 cooperatively associated with the wall of the ball-conducting conduit 22, which ball sensors 80 may effectively function to sense the motion or position of a roulette ball 90 as it travels through the ball-conducting conduit 22.

The ball sensors 80, having sensed the position or motion of a roulette ball 90, may further function to actuate the conduit-illumination means, as for example, by closing a circuit therewith. The conduit-illumination means, as preferably defined by a series of lights 81 (colored candescent-type lighting, light emitting diode(LED)-type lighting, or similar other type lighting) for illuminating the ball-conducting conduit 22 as the roulette ball(s) 90 pass therethrough or in sync with a passing or conduit-conducting roulette ball 90. It is contemplated that the conduit-illumination means emit light having varied wavelengths or having varied colors (such as rainbow type colors) for visually enhancing the roulette gaming experience. For example, in FIG. No. 16, the colors Yellow 62, Red 60, and Blue 64 have been generically depicted and referenced.

It is here noted that roulette is a game of anticipation. The visual enhancement of ball delivery, as achieved by visually highlighting the roulette ball path through the ball-conducting conduit 22 with certain illumination, is thus contemplated to heighten the player's sense of anticipation and thus enhance the overall roulette gaming experience. Other visual enhancements may preferably include certain tower-disguising means for disguising the ball-delivery tower 11. It is contemplated that tower-disguising means may be preferably defined by or resemble some sort of fanciful creature 70 as generally depicted in FIG. No. 17. Notably, the ball-conducting conduit 22 (or at least portions thereof) and the ball-delivery tower 11 are preferably concealed by the fanciful creature 70 as generally depicted in the noted figure. It is contemplated that the fanciful creature may be adapted for tying in with the underlying roulette theme. For example, as generally depicted, a dragon-type fanciful creature 70 may tie in with an underlying Mah Jong Roulette type game incorporating Chinese tiles and/or meaningful Mah-Jong type symbolic characters borne by the sectors 53.

In further keeping with the notion that the roulette apparatus of the present invention may preferably comprise certain wheel-monitoring means, it is further contemplated that the fanciful creature 70 or other tower-disguising means may further comprise a monitor-enabling window 71 as generally further depicted and referenced in FIG. No. 17. The wheel-monitoring means are thus cooperable with the monitor-enabling window 71 for enabling players or gamers to view video of roulette gaming via the monitor-enabling window 71. It is further contemplated that the monitor-enabling window 71 may further preferably comprise certain window-disguising means such as a jewel-resembling structure 72.

From an inspection of FIG. No. 17, it may be seen that the fanciful creature 70 appears as though it is wearing the jewel-resembling structure 72. The jewel-resembling structure 72, as worn by the fanciful creature 70, however, are together designed to structurally disguise the underlying ball-delivery mechanisms and means for monitoring game play. It is noteworthy, for example, that the monitor-housing arm of the ball-delivery tower may extend toward the wheel axis of rotation 100 and simultaneously be concealed by the lower jaw of a fanciful creature 70 as generally depicted in FIG. No. 17 as at 75. It is further noteworthy that video surveillance is ubiquitous in gaming establishments. The incorporation of disguised video surveillance equipment and/or game-monitoring equipment is thought to play into players' awareness that surveillance and video monitoring are part and parcel of gaming and is thus thought to further enhance the roulette gaming experience elicited from the roulette apparatus of the present invention.

While the above description contains much specificity, this specificity should not be construed as limitations on the scope of the invention, but rather as an exemplification of the invention. For example, as is described hereinabove, it is contemplated that the present invention essentially discloses a roulette apparatus for enabling and enhancing roulette gaming, which roulette apparatus comprises a roulette wheel assembly, a ball-delivery tower, and ball-delivery means. The roulette wheel assembly comprises a roulette wheel and certain means for rotating the roulette wheel about a wheel axis of rotation. The roulette wheel comprises a ball-receiving upper wheel surface having ball-receiving sectors.

The ball-delivery tower essentially comprises a tower support portion and optionally comprises a tower arm. Notably, the tower support portion has a certain vertical tower dimension. The ball-delivery means function to deliver at least one roulette ball to the roulette wheel assembly, and essentially comprise a ball inlet end, a ball outlet end, and ball-conducting conduit extending intermediate the ball inlet and ball outlet ends. It is contemplated that the ball-conducting conduit may comprise a peak portion, which peak portion may possibly coincide with the ball inlet end (as, for example, by ramping the roulette ball down to the roulette wheel assembly). The vertical dimension of the tower may well function to support the peak portion. The ball outlet end, in any event, is preferably being positioned for outletting the roulette ball upon the upper wheel surface.

Notably, the peak portion may well function to impart maximum ball potential energy, which maximized ball potential energy may be converted to ball kinetic energy for imparting final translational ball motion to a roulette ball conducted through the ball-conducting conduit to the ball outlet end. The ball outlet end, being properly positioned in superior adjacency to the upper wheel surface, may well function to properly launch the roulette ball upon the upper wheel surface in such a way as to visually resemble a self-launching roulette ball from the players' point of view.

In this last regard, an essential concept worth noting is that the roulette ball 90 may effectively (that is from the players' perspective) self-launch upon the sphere-launching tracks 19 if otherwise provided with sufficient (manually-enabled) guidance or direction to the peak portion. Certain means may be designed for guiding or directing the roulette ball 90 to the peak portion 23 as exemplified by the foregoing descriptions. The roulette ball 90, having certain maximized potential energy relative to the roulette wheel assembly 10, and provided with means to minimize the potential energy, may increase its kinetic energy by way of classical physical principles in orderly to self-launch from the ball outlet end 21. Notably, from an inspection of FIG. No. 1 (a player's vantage point), the ball inlet end 20 is not seen. The player, thus, sees a roulette ball 90 exit the ball outlet end 21 for embarking roulette gaming action.

The concepts of the present roulette apparatus would seem to further support certain roulette gaming methodology, or at least certain roulette ball delivery methodology. In this regard, it is further contemplated that the present invention essentially discloses a roulette ball delivery method for delivering a roulette ball to a roulette wheel comprising the steps of impulsing (as for example, by spring-actuating a ball launcher into a roulette ball) or sucking (as for example, by reducing the pressure in the deliverable direction) a roulette ball into ball-conducting conduit thereby imparting initial ball kinetic energy; conduit-conducting the roulette ball; directing the ball-conducting conduit to a roulette wheel; and outletting the conduit-conducted roulette ball onto the roulette wheel with a final, ball-launching kinetic energy.

The step of conduit-conducting the roulette ball is further thought to preferably comprise the step of maximizing ball potential energy and decrementing the initial ball kinetic energy. In this regard, if the ball inlet is of lesser vertical dimension than the maximum vertical dimension of the conduit, then the initial kinetic energy may be decremented as energy is converted to potential energy. The delivery method may thus be said to comprise the steps of: converting a kinetically energetic conduit-conducted roulette ball into the potentially energetic roulette ball (as for example, by delivering a conduit-conducting roulette ball to the peak portion); converting the potentially energetic roulette ball (i.e a roulette ball placed at a potential energetic position (such as at the peak portion) or a roulette ball that has been spring compressed, or a roulette ball that has been positioned adjacent ball-accelerating means) into a kinetically energetic roulette ball; conduit-conducting the kinetically energetic roulette ball to a ball outlet; and outletting the conduit-conducted roulette ball onto a roulette wheel with ball-launching kinetic energy. In any event, a maximized ball potential energy may be converted into ball kinetic energy in order to effect a so-called self-launching roulette ball.

Still further, it is contemplated that the roulette apparatus of the present invention essentially functions to enhance roulette gaming by way of creating a self-launching roulette ball effect. The roulette apparatus of the present invention may thus be said to comprise a roulette wheel and certain means for effecting a self-launching roulette ball, including ball-conducting conduit for converting a potentially energetic roulette ball to a kinetically energetic roulette ball and for outletting the kinetically energetic roulette ball upon the roulette wheel. Since the effect of a self-launching roulette ball is achieved, in part, by the opaque quality of the tower 11 and/or certain opaque quality of the ball-conducting conduit, it is further contemplated that the means for effecting a self-launching roulette ball further comprises certain means for concealing the kinetically energetic roulette ball from a player's perspective (such as the tower 11, the tower-disguising means, the ball-conducting conduit, etc.), the means for concealing the kinetically energetic roulette ball for enhancing the self-launching roulette ball effect.

As stated or otherwise implied from the foregoing, it is contemplated that any number of ball-accelerating means may well function to impart kinetic energy to deliverable roulette balls 90. In this regard, it is further contemplated that incorporating certain ball-accelerating means may well function not only to accelerate roulette balls 90, but further function to distance or separate the operator or croupier from the roulette gaming experience (so as to effect a more alluring or enhanced roulette gaming experience). Gaming regulation, may, for example, look with disfavor upon roulette gaming otherwise influenced with operator- or croupier-controlled wheel rotation velocity; operator- or croupier-controlled ball-delivery timing; operator- or croupier-controlled ball-delivery speed, etc. It is thus contemplated that the ball-accelerating means may be further defined by certain objectively controlled central processing means (CPU) or other computer-type controls for regulating ball-acceleration and randomly timing periodic ball delivery with separately controlled roulette wheel rotation.

In this regard, it is contemplated that the roulette apparatus of the present invention may well comprise or be cooperable with a ball-housing magazine or ball magazine 25 as illustrated and referenced in FIG. Nos. 18-23, inclusive. The ball magazine 25 or similar other ball-delivery hopper functions to receive and temporarily house a plurality of magazine-deliverable roulette balls 90 to the ball-accelerating means, such as a ball collider assembly. The ball collider cooperable with the magazine 25 may be defined by structure reminiscent of the ball collider assembly 30 or may be defined by a computer-controlled solenoid assembly 27 as further generally diagrammatically depicted and referenced in FIG. Nos. 18-23. As stated, the diagrammatically solenoid assembly may be governed by a computer or CPU 28, for periodically closing a solenoid switch (as at 26) and thereby actuating the solenoid type assembly 27, which assembly may be said to include or actuate a compression spring 31 (via the resulting magnetic force (as at 105) (as generally depicted in FIG. Nos. 19 and 22) from an otherwise relaxed state (as generally depicted in FIG. Nos. 18, 20, 21, and 23). When the switch 26 is again opened under the governance of the CPU 28 (preferably pre-programmed with instructions for periodically opening and closing the switch 26), the restorative spring forces (as at 106) inherent in the compression spring 31 function to return the spring 31 to a relaxed state and carry the plunger 32 with elastic collision-enabling tip 33 into a deliverable roulette ball 90 (as generally depicted in FIG. Nos. 20 and 23) for impulsing the deliverable roulette ball 90 into the ball-conducting conduit 22 from the ball chamber.

It will thus be seen that the magazine-deliverable roulette balls 90 of the present invention may be made deliverable to the ball inlet 20 and/or ball-conducting conduit 22 and thereby made further subject to the ball-accelerating means. The ball magazine 25 is thus further cooperable with periodic, self-governing ball-accelerating means such as the CPU-controlled ball collider assembly or solenoid assembly 27 diagrammatically depicted in FIG. Nos. 18-23, inclusive. It is contemplated that the periodic, self-governing ball-accelerating means may well function to effect a periodic series of self-launching roulette balls 90 by almost completely eliminating the need for an operator or 20 croupier (whose role may ostensibly be limited changing magazines 25 or refilling the magazine 25).

Accordingly, although the invention has been described by reference to a preferred roulette game and certain methodology associated therewith, it is not intended that the novel game or gaming method be limited thereby, but that modifications thereof are intended to be included as falling within the broad scope and spirit of the foregoing disclosure, the following claims and the appended drawings.

We claim:

1. A roulette apparatus, the roulette apparatus for enabling and enhancing roulette gaming, the roulette apparatus comprising:

a roulette wheel assembly, the roulette wheel assembly comprising a roulette wheel, the roulette wheel comprising a ball-receiving upper wheel surface;

a ball-delivery tower, the ball delivery tower comprising a tower support portion, the tower support portion having a vertical tower dimension; and ball-delivery means, the ball-delivery means for delivering a roulette ball to the upper wheel surface, the ball-delivery means comprising a ball inlet, a ball outlet, and ball-conducting conduit intermediate the ball inlet and ball outlet, the ball-conducting conduit comprising a peak portion, the vertical tower dimension supporting the peak portion, the ball outlet being positioned for outletting the roulette ball upon the upper wheel surface, the peak portion for imparting maximum ball potential energy, the maximized ball potential energy being convertible to ball kinetic energy for imparting final ball kinetic energy to a conduit-conducted roulette ball, the roulette apparatus thus for enabling and enhancing roulette gaming; wherein the ball-conducting conduit comprises cooperable ball-sensing and conduit-illumination means, the ball-sensing means for sensing the motion of a conduit-conducting roulette ball and actuating the conduit-illumination means, the conduit-illumination means for illuminating the ball-conducting conduit as the conduit-conducting roulette ball passes therethrough.

2. The roulette apparatus of claim 1 comprising wheel-monitoring means, the wheel-monitoring means for capturing and relaying video imagery of the upper wheel surface to peripheral video display means, the peripheral video display means for enabling players to view video imagery of roulette gaming.

3. The roulette apparatus of claim 1 wherein the upper wheel surface comprises ball-supporting sectors, the ball-supporting sectors bearing select colorization, the select colorization being selected from the color group consisting of red, orange, yellow, green, blue, indigo, and violet.

4. The roulette apparatus of claim 3 wherein the ball-supporting sectors bear meaningful symbolic indicia.

5. The roulette apparatus of claim 1 wherein the ball inlet comprises ball-accelerating means, the ball-accelerating means for imparting initial kinetic energy to a deliverable roulette ball, the initial kinetic energy for conducting the deliverable roulette ball away from the ball inlet via the ball-conducting conduit.

6. The roulette apparatus of claim 5 wherein the ball inlet comprises a ball magazine, the ball magazine for housing a plurality of magazine-deliverable roulette balls, the magazine-deliverable roulette balls being deliverable to the ball inlet and thereby being made subject to the ball-accelerating means.

7. The roulette apparatus of claim 6 wherein the ball magazine is cooperable with periodic, self-governing ball-accelerating means, the periodic, self-governing ball-accelerating means for effecting a periodic series of self-launching roulette balls.

8. The roulette apparatus of claim 5 wherein the ball-accelerating means are defined by a ball-collider, the ball-collider being spring-actuable for imparting a ball-accelerating impulse to the deliverable roulette ball, the impulse providing sufficient kinetic energy to drive the deliverable roulette ball to the peak portion.

9. The roulette apparatus of claim 5 wherein the ball-accelerating means are defined by pressure-reduction means, the pressure-reduction means for reducing pressure adjacent the deliverable roulette ball via the ball-conducting conduit, the reduced pressure for forcefully driving the deliverable roulette ball to the peak portion.

10. The roulette apparatus of claim 1 wherein the conduit-illumination means emit light having varied wavelengths, the varied wavelengths for visually enhancing roulette gaming.

11. The roulette apparatus of claim 1 comprising tower-disguising means, the tower-disguising means for concealing the ball-delivery tower.

12. The roulette apparatus of claim 11 wherein the tower-disguising means comprises a monitor-enabling window cooperable with wheel-monitoring means for enabling players to view video imagery of roulette gaming.

13. A roulette apparatus, the roulette apparatus for enabling and enhancing roulette gaming, the roulette apparatus comprising:

a roulette wheel assembly, the roulette wheel assembly comprising a roulette wheel, the roulette wheel comprising an upper wheel surface; and ball-delivery means, the ball-delivery means for delivering a roulette ball to the upper wheel surface, the ball-delivery means comprising ball-conducting conduit, the ball-conducting conduit comprising a peak portion, the peak portion for imparting maximum ball potential energy, the maximized ball potential energy being convertible for maximizing ball kinetic energy intermediate the peak portion and the upper wheel surface; wherein the ball-conducting conduit comprises cooperable ball-sensing and conduit-illumination means, the ball-sensing means for sensing the position of a conduit-conducting roulette ball and actuating the conduit-illumination means, the conduit-illumination means for illuminating the ball-conducting conduit in sync with the conduit-conducting roulette ball.

14. The roulette apparatus of claim 13 comprising a ball-delivery tower, the ball-deliver tower for vertically supporting the peak portion.

15. The roulette apparatus of claim 14 wherein the ball-delivery tower comprises wheel-monitoring means, the wheel-monitoring means for capturing and relaying video imagery of the upper wheel surface to peripheral video display means.

16. The roulette apparatus of claim 13 wherein the ball-delivery means function to simultaneously deliver a plurality of roulette balls to the upper wheel surface.

17. The roulette apparatus of claim 13 wherein the ball-conducting conduit comprises ball-accelerating means, the ball-accelerating means for imparting kinetic energy to a deliverable roulette ball, the impartable kinetic energy for conducting the deliverable roulette ball through the ball-conducting conduit.

18. The roulette apparatus of claim 17 comprising a ball magazine cooperable with the ball-conducting conduit, the ball magazine for housing a plurality of magazine-deliverable roulette balls, the magazine-deliverable roulette balls being deliverable to the ball-conducting conduit for receiving the impartable kinetic energy.

19. The roulette apparatus of claim 18 wherein the ball magazine is cooperable with periodic, self-governing ball-accelerating means, the periodic, self-governing ball-accelerating means for effecting a periodic series of self-launching roulette balls.

20. The roulette apparatus of claim 17 wherein the ball-accelerating means are defined by ball-collision means, the ball-collision means for imparting a ball-accelerating impulse to the deliverable roulette ball via substantially elastic collisions therewith, the ball-accelerating impulses providing sufficient kinetic energy to conduct deliverable roulette balls through the ball-conducting conduit.

21. The roulette apparatus of claim 17 wherein the ball-accelerating means are defined by pressure-reduction means, the pressure-reduction means for reducing pressure adjacent a deliverable roulette ball via the ball-conducting conduit, the reduced pressure for conducting the deliverable roulette ball through the ball-conducting conduit.

22. The roulette apparatus of claim 13 comprising tower-disguising means, the tower-disguising means for concealing the ball-conducting conduit.

23. The roulette apparatus of claim 13 comprising tower-disguising means, the tower-disguising means for concealing the ball-conducting conduit and wheel-monitoring means.

24. A roulette apparatus, the roulette apparatus for enabling and enhancing roulette gaming, the roulette apparatus comprising:

a roulette wheel assembly, the roulette wheel assembly comprising a roulette wheel; and means for effecting a self-launching roulette ball, said means comprising ball-conducting conduit, the ball-conducting conduit for converting a potentially energetic roulette ball to a kinetically energetic roulette ball and for outletting the kinetically energetic roulette ball upon the roulette wheel; wherein the ball-conducting conduit comprises cooperable ball-sensing and conduit-illumination means, the ball-sensing means for sensing the position of a conduit-conducting roulette ball and actuating the conduit-illumination means, the conduit-illumination means for illuminating the ball-conducting conduit in sync with the conduit-conducting roulette ball.

25. The roulette apparatus of claim 24 wherein the means for effecting a self-launching roulette ball comprises means for concealing the kinetically energetic roulette ball from a player's perspective, the means for concealing the kinetically energetic roulette ball for enhancing a self-launching roulette ball effect.

26. The roulette apparatus of claim 24 comprising a ball magazine cooperable with the ball-conducting conduit, the ball magazine for housing a plurality of magazine-deliverable roulette balls, the magazine-deliverable roulette balls being periodically deliverable to the ball-conducting conduit.

27. The roulette apparatus of claim 26 wherein the ball magazine is cooperable with periodic, self-governing ball-accelerating means, the periodic, self-governing ball-accelerating means for effecting a periodic series of self-launching roulette balls.

* * * * *